US007428978B2

(12) United States Patent
Lewis et al.

(10) Patent No.: US 7,428,978 B2
(45) Date of Patent: Sep. 30, 2008

(54) SHEET MATERIAL DISPENSER

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 243 days.

(21) Appl. No.: 11/140,342

(22) Filed: May 27, 2005

(65) Prior Publication Data

US 2006/0266758 A1 Nov. 30, 2006

(51) Int. Cl.
*B65H 3/00* (2006.01)

(52) U.S. Cl. ..... 221/39; 221/37; 221/40; 221/151; 221/152; 221/213; 221/249; 221/259

(58) Field of Classification Search ..... 221/210, 221/37, 213, 249, 214, 269, 254, 259, 251, 221/270, 151, 152
See application file for complete search history.

(56) References Cited

U.S. PATENT DOCUMENTS

| | | | | | |
|---|---|---|---|---|---|
| 930,619 | A | * | 8/1909 | Russell | 221/36 |
| 1,511,812 | A | | 10/1924 | Horwitt | |
| 1,603,714 | A | | 10/1926 | Rappleye | |
| 2,247,800 | A | | 7/1941 | Broeren et al. | |
| 2,588,152 | A | * | 3/1952 | Newman | 221/37 |
| 3,094,323 | A | * | 6/1963 | Catania | 271/33 |
| 3,243,078 | A | | 3/1966 | Pherson | |
| 3,266,665 | A | | 8/1966 | Eakens | |
| 3,301,746 | A | | 1/1967 | Sanford et al. | |
| 3,322,617 | A | | 5/1967 | Osborne | |
| 3,650,882 | A | | 3/1972 | Thomas | |
| 4,071,165 | A | * | 1/1978 | Leopoldi | 221/259 |
| 4,100,324 | A | | 7/1978 | Anderson et al. | |
| 4,121,726 | A | * | 10/1978 | Pemberton | 221/37 |
| 4,436,780 | A | | 3/1984 | Hotchkiss et al. | |
| 4,659,609 | A | | 4/1987 | Lamers et al. | |
| 4,737,393 | A | | 4/1988 | Linkous | |
| 5,048,589 | A | | 9/1991 | Cook et al. | |
| 5,284,703 | A | | 2/1994 | Everhart et al. | |
| 5,399,412 | A | | 3/1995 | Sudall et al. | |
| 5,494,554 | A | | 2/1996 | Edwards et al. | |
| 5,540,354 | A | | 7/1996 | Annand | |

(Continued)

FOREIGN PATENT DOCUMENTS

| | | |
|---|---|---|
| GB | 917049 | 1/1963 |

*Primary Examiner*—Gene O. Crawford
*Assistant Examiner*—Timothy R Waggoner
(74) *Attorney, Agent, or Firm*—Sue C. Watson

(57) ABSTRACT

A dispenser and system for dispensing sheet material is provided. The dispenser includes a housing including a container and a lid. The container and lid cooperate to provide an inner surface formed to include an internal compartment configured to hold sheet material. The housing includes an exit port for withdrawal of sheet material therefrom. The dispenser also includes a sheet mover mounted to the housing. A portion of the sheet mover is configured to move over at least a portion of a sheet material positioned in the housing such that at least the portion of the sheet material is moved away from additional sheet materials positioned adjacent thereto by the sheet mover. The portion moved away is positioned to be easily withdrawn through the exit port by a user. The system includes the dispenser having a sheet mover and a plurality of sheet materials disposed in the dispenser. A disposable, one-use dispensing system is provided as well.

30 Claims, 30 Drawing Sheets

U.S. PATENT DOCUMENTS 5,607,551 A 3/1997 Farrington, Jr. et al.
5,672,248 A 9/1997 Wendt et al.
5,674,590 A 10/1997 Anderson et al.
5,687,876 A * 11/1997 Lucas, Jr. ..... 221/259
5,716,691 A 2/1998 Chan
5,772,845 A 6/1998 Farrington, Jr. et al.
5,776,306 A 7/1998 Hepford
5,904,971 A 5/1999 Anderson et al.
6,077,590 A 6/2000 Archer et al.
6,096,152 A 8/2000 Anderson et al.
6,248,212 B1 6/2001 Anderson et al.
6,273,996 B1 8/2001 Hollenberg et al.
6,533,145 B2 3/2003 Lewis et al.

* cited by examiner

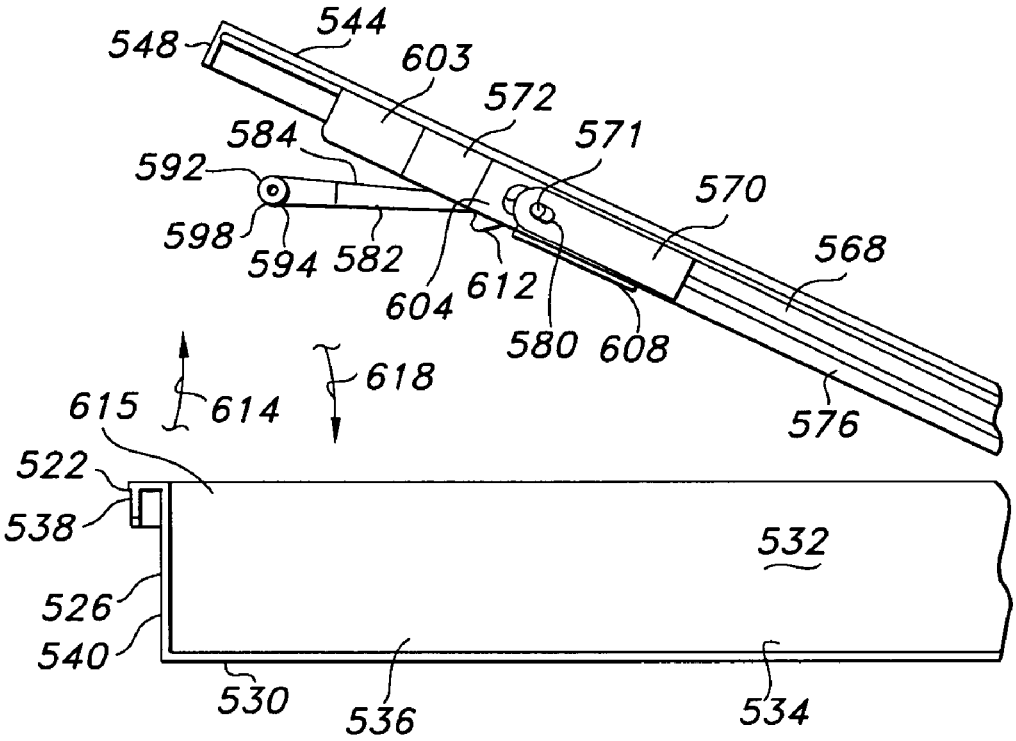
FIG. 67
FIG. 68
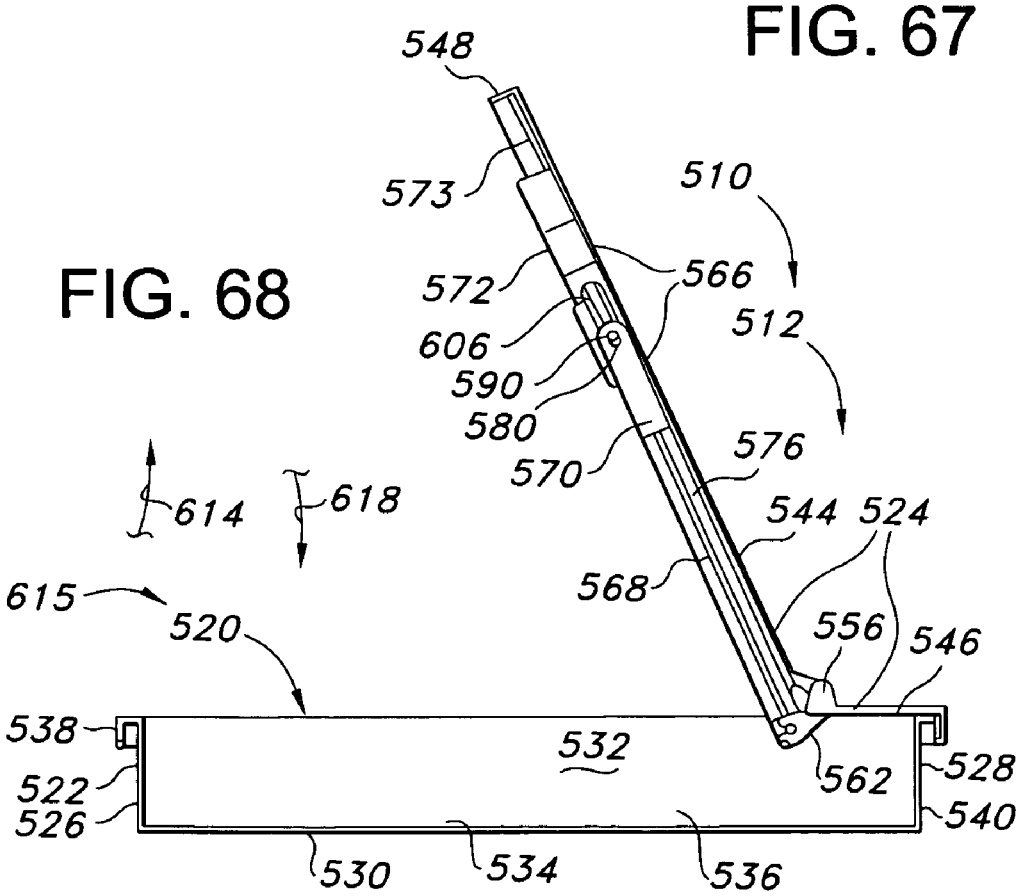

SHEET MATERIAL DISPENSER

BACKGROUND

Sheet materials, such as, but not by way of limitation, wipers stacked in a generally aligned configuration, are used for certain "clean" applications such as surgical rooms, electronic manufacturing, automotive painting and finishing, aerospace applications, and the like. Critical applications, such as procedures in clean rooms where silicone wafers are prepared to produce materials and/or apparatus such as integrated circuit devices, computer hard drives and the like make the use of wound sheet materials or interfolded sheet materials undesirable to use since products which can be interfolded or delivered wound can result in linting which can ultimately contaminate the delicate silicone products. Wipers or sheet material for these clean applications must be "lint free" and are generally produced as individual sheets with their edges sealed normally by thermal or laser means. These wipers are usually sold in a stack of wipers which are not interfolded, and which are either dry or premoistened, generally, but not by way of limitation, with an isopropyl alcohol (IPA). Moistening causes the wipers in the stack to cling together, making the separation of one wiper from the stack by an individual wearing gloves very difficult. However, it is desirable to dispense one wipe at a time, particularly in a clean room setting.

To address this problem, wipers have been wadded or otherwise packaged as a plurality of individual wipers packaged in pouches or pails. Pouches generally have a tabbed opening which is sealed with a resealable adhesive flap. Such adhesives often lose their ability to seal once they are wetted with an IPA or other liquid, and the wipers dry out. Pails employ a lid that can be difficult to remove and/or which often is not adequately sealed after use, allowing the alcohol to evaporate and the wipers to again dry out. Further, use of a pouch or pail requires a user to hold the pouch or pail with one hand and withdraw the wiper with the other hand.

It would be desirable for ergonomic, production efficiency and cost-in-use to provide a dispenser which would dispense one premoistened or dry wiper at a time. Such a dispenser would desirably require the use of only one hand to withdraw a wiper from the dispenser. Such a dispenser may employ a mounting bracket, and so forth, to secure the dispenser before, during and/or after withdrawal of sheet material therefrom.

DEFINITIONS

As used herein, the term "exit port" or "dispensing port" is the opening in a housing of a dispenser for the passage of sheet material out of the dispenser.

As used herein, the terms "sheet material", "sheet materials", "wiper" "wipes" and "wipers" are interchangeable, and mean a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, cellulosic and/or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, integrally molded ball and socket type, circular openings in components joined with a hinge pin and living hinges. Living hinges may be constructed from plastic and formed integrally between two members. A living hinge permits pivotable movement of one member in relation to another integrally connected member.

As used herein, the term "couple" includes, but is not limited to, joining, connecting, fastening, linking, or associating two things integrally or interstitially together.

As used herein, the terms "configure", "configured" and/or "configuration" means to design, arrange, set up, or shape with a view to specific applications or uses. For example: a military vehicle that was configured for rough terrain; configured the computer by setting the system's parameters.

As used herein, the term "sheet mover" refers to a portion of the pivotal leg which is used to move one or a few sheet materials away from a stack or plurality of sheet materials. Specifically, the embodiments shown herein include a toe of the pivotal let having a pick which has at least one tooth thereon. In addition, the embodiments shown herein include a portion of the toe which ruffles or bunches one or a few sheet materials away from a stack or plurality of sheet material. These embodiments are intended to be non-limiting, and other embodiments which create the movement of sheet material, either by snagging or grabbing the sheet material, or, alternatively, by ruffling or bunching the sheet material may be used.

As used herein, the term "pick" refers to a sharp or semi-sharp, generally pointed instrument, in this instance, the pick, and desirably, one or more teeth of the pick, which is used to pierce, make a small hole in, snag without piercing, grab or drag by means of friction a sheet material.

As used herein, the term "pusher" refers to an instrument, in this instance, at least a portion of the pivotal leg, and desirably the toe of the pivotal leg, which acts to ruffle, wrinkle or bunch a portion of one or a few sheet materials away from a stack or plurality of sheet materials.

As used herein, the terms "snag" or "grab" refers to contacting a thing, such as a portion of one or more sheet materials, and seizing and pulling the contacted portion of the sheet material.

As used herein, the terms "push", "bunch" "ruffle" and/or "wrinkle" refers to contacting and applying pressure to something, such as a portion of one or a few sheet materials, thereby creating a small furrow, ridge, hill or crease on a normally smooth surface for the purpose of moving the portion of the one or a few sheet materials.

As used herein, the term "about" includes plus or minus 10 percent of the numeral or a stated or inherent amount at each end of a range.

These terms may be defined with additional language in the remaining portions of the specification.

SUMMARY OF THE INVENTION

In response to the difficulties and problems discussed herein, a dispenser for dispensing sheet material is provided. The dispenser includes a housing which includes a container and a lid. The container and the lid cooperate to provide an inner surface formed to include an internal compartment configured to hold sheet material. The housing also includes an exit port for withdrawal of sheet material therefrom. The dispenser further includes a sheet mover mounted to the housing. A portion of the sheet mover is configured to move over a sheet material positioned in the housing such that at least a portion of the sheet material is moved away from additional sheet materials positioned adjacent thereto by the sheet mover. The portion of the sheet material moved away is positioned to be easily withdrawn through the exit port by a user.

In another aspect of the invention, a system for dispensing sheet material is provided. The system comprises a dispenser having a housing. The housing includes a container and a lid. The container and lid cooperate to provide an inner surface formed to include an internal compartment configured to hold sheet material. The housing includes an exit port for withdrawal of sheet material therefrom. The housing also includes a sheet mover mounted to the housing. A portion of the sheet mover is configured to move over at least a portion of a sheet material. The system also includes a plurality of sheet material disposed in the internal compartment of the housing such that at least one sheet material is positioned adjacent the sheet mover. When the sheet mover moves over a portion of the sheet material, at least the portion is moved away from the plurality of sheet material by the sheet mover such that the portion is positioned to be easily withdrawn through the exit port by a user.

In yet another aspect of the invention, a disposable, one-use system for dispensing sheet material is provided. The system comprises a dispenser having a housing. The housing includes a container and a lid. The container and lid cooperate to provide an inner surface formed to include an internal compartment configured to hold sheet material. The housing includes an exit port for withdrawal of sheet material therefrom. The housing also includes a sheet mover mounted to the housing. A portion of the sheet mover is configured to move over at least a portion of one sheet material. The system also includes a plurality of sheet material disposed in the internal compartment of the housing such that at least one sheet material is positioned adjacent the sheet mover. When the sheet mover moves over a portion of the sheet material, at least the portion of the sheet material is moved away from the plurality of sheet material by the sheet mover such that the portion is positioned to be easily withdrawn through the exit port by a user.

Other features and aspects of the present invention are discussed in greater detail below.

BRIEF DESCRIPTION OF THE DRAWINGS

The present invention will be more fully understood from the following detailed description, taken in conjunction with the accompanying drawings (not to scale), wherein like reference numerals refer to like parts, and in which:

FIG. 67 is a partial side sectional view of the dispenser of the present embodiment, showing the movement of the sheet mover into the shield as the lid is lifted;

FIG. 68 is a side sectional view of the dispenser of the present embodiment, showing the sheet mover positioned completely in the shield;

DETAILED DESCRIPTION

Figure 1:
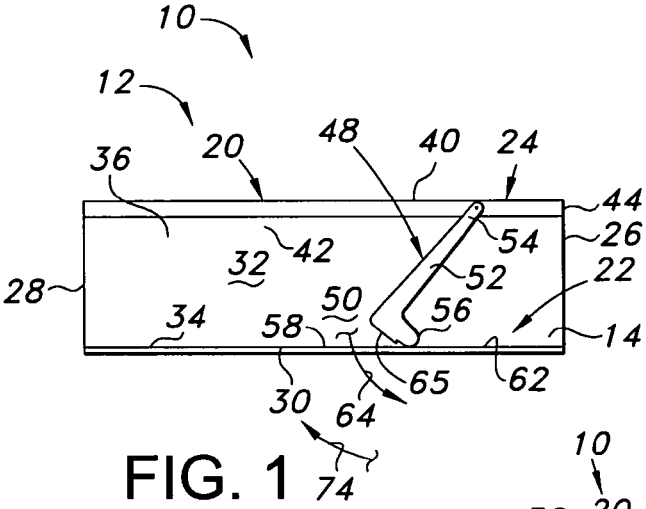
FIG. 1 is a side sectional view of the dispenser of the present invention, showing a housing having a lid and a tray container.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing stacks of sheet materials. Such sheet materials may include, but are not limited to, woven materials, nonwoven materials, synthetic materials, natural materials, foils, polymer films, any combination thereof, and so forth. Exemplary sheet materials for which the present invention is suitable include, but are not limited to, absorbent sheet materials such as towels, wipers, tissue, napkins, and so forth. The specific composition of the sheet materials dispensed can vary as desired. Exemplary sheet materials and methods of making the same include, but are not limited to, those described in U.S. Pat. Nos. 3,301,746; 3,322,617; 3,650,882; 4,100,324; 4,436,780; 4,659,609; 4,737,393; 5,048,589; 5,284,703; 5,399,412; 5,494,554; 5,607,551; 5,672,248; 5,674,590; 5,716,691; 5,772,845; 5,776,306; 5,904,971; 6,077,590; 6,248,212; 6,273,996; 6,096,152; and so forth. While woven and/or nonwoven sheet-like products are generally discussed with regard to the sheet material shown and/or described in embodiments herein, it will be understood that various other products could be substituted therefore.

The sheet materials for which the present invention is suitable may be wound around a core (not shown). Alternatively, the sheet materials may be wound without a core, as a coreless roll of sheet material. Desirably, the sheet materials for which the present invention is suitable are provided as a stack of sheet materials. Such sheet materials may be connected or un-connected. The sheet materials may be folded, interfolded, tabbed and/or festooned. Desirably, the sheet materials are provided as individual sheets in a stack of generally aligned sheet materials.

Figure 70:
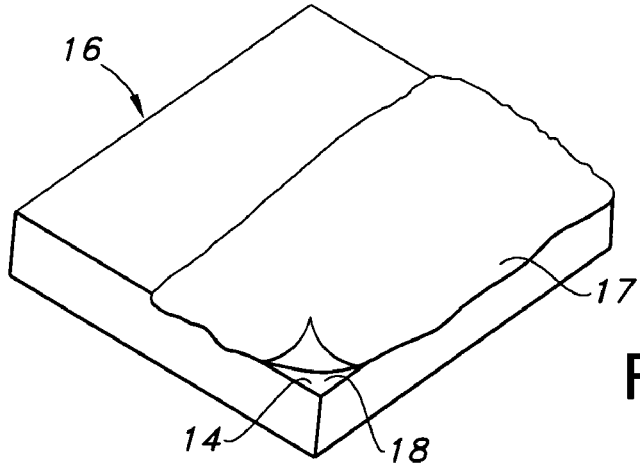
FIG. 70 is a perspective view of a cartridge of stacked sheet materials, the cartridge having a removable lid covering a portion of the upper surface of the cartridge, one corner of the removable lid lifted for illustrative purposes.

The present invention, as illustrated in FIGS. 1-15, comprises a system 10 which includes a dispenser 12 and sheet materials 14. The sheet materials 14 may be provided in a cartridge 16, which may include a removable seal or lid portion 17 (shown best in FIGS. 70-72). The sheet materials 14 may be premoistened with a liquid. Alternatively, the sheet materials 14 may be dry. Desirably, the sheet materials 14 are provided as a stack 18 of single or individual sheet materials in a generally aligned and planar orientation.

FIGS. 1-4 illustrate a schematic cross-sectional view of a dispenser housing 20 which includes a tray container 22 and a cover or lid 24. The tray container 22 of the dispenser housing 20 desirably includes a front wall 26 and a back wall 28 which intersect a lower end 30. Spaced-apart side walls 32 also intersect the lower end 30 and cooperate with the front wall 26 and the back wall 28 to provide an inner surface 34 which provides an internal compartment 36. The inner surface 34 and internal compartment 36 formed thereby are configured to receive a stack 18 of generally aligned sheet materials 14 or a cartridge 16 of sheet materials 14 therein.

At least one portion of the lid 24 is desirably pivotably coupled to the tray container 22, and desirably provides sufficient closure to maintain the sheet material 14 in a premoistened state when liquid is provided with or added to the sheet material 14. The lid 24 may comprise one piece which includes an upper surface 40, a lower surface 42, and a perimeter edge 44. The lid 24 extends at least to an upper perimeter edge 46 of the tray container 22. Alternatively, the lid 24 may include front and back walls as well as sidewalls which cooperate to provide the lid (not shown).

The lid 24 includes a pawl-like sheet mover or pivotal leg 48 having, at one end, a foot 50. An elongated portion 52 extends between the foot 50 and an opposite end 54 of the pivotal leg 48, which is pivotably coupled to the lower surface 42 of the lid 22 via a hinge or similar apparatus. FIG. 1 shows the position of the pivotal leg 48 when at rest in the housing 20 without sheet materials 14 therein, showing a smooth, rounded toe 56 of the foot 50 positioned against an upper surface 58 of the lower end 30 of the tray container 22. The portion of the toe 56 may be rounded to remove any frictional resistance and to permit smooth movement of the toe 56 over the sheet material 14 until the toe 56 reaches a point of desirably moving and/or lifting the sheet material 14, as will be described in detail below. The toe 56 may also be formed from and/or include wheels, rollers, and so forth (not shown).

Figure 2:
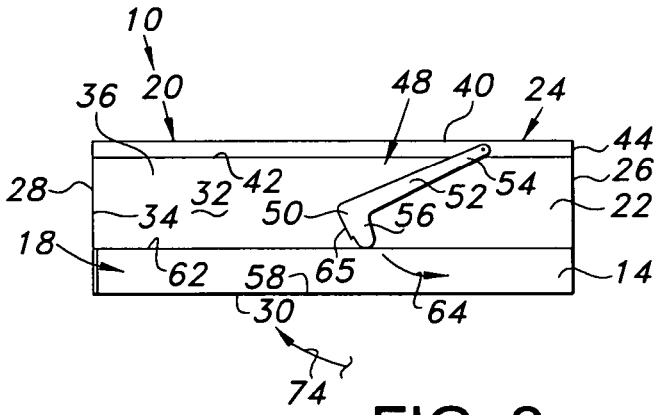
FIG. 2 is a side sectional view of a system and the dispenser of FIG. 1, but showing the sheet mover positioned against sheet material disposed in the dispenser.
Figure 3:
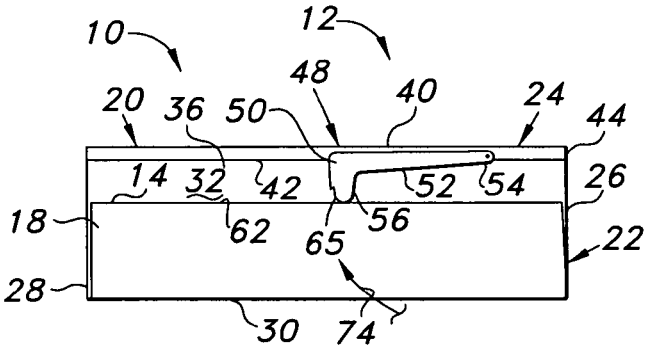
FIG. 3 is a side sectional view of the dispenser of FIG. 1, but showing the dispenser filled with sheet material and the non-dispensing position of the sheet mover.
Figure 4:
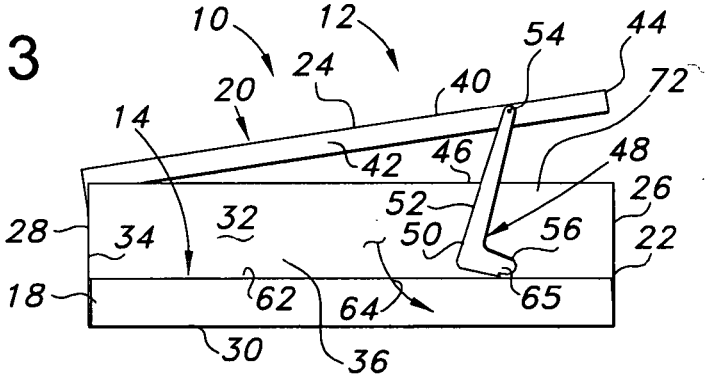
FIG. 4 is a side sectional view of the dispenser of FIG. 1, but showing the lid partially opened and the sheet mover positioned to engage a top sheet of a stack of sheet materials positioned in the dispenser.
Figure 5:
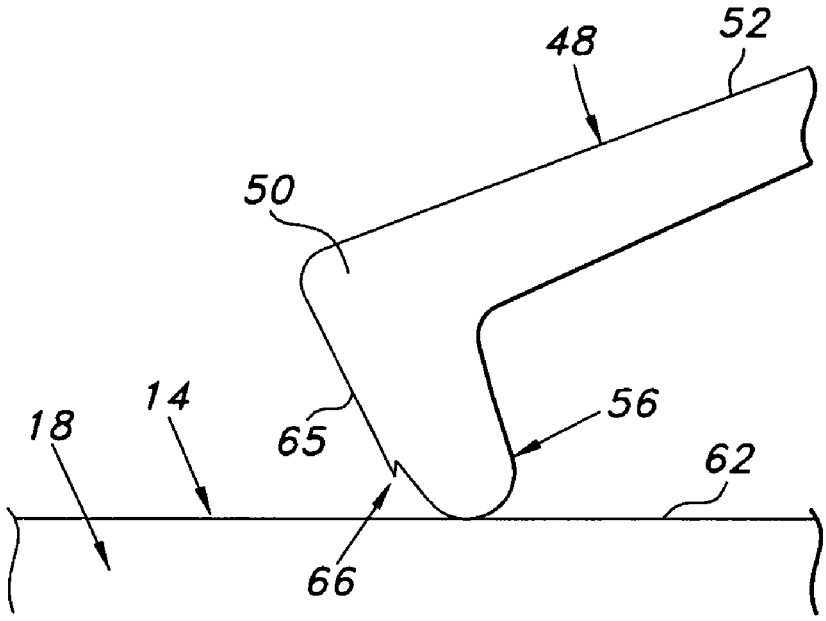
FIG. 5 is a partial side view of the dispenser of FIG. 2, showing the position of the toe and pick of the sheet mover relative to the top sheet of the stack of sheet material.
Figure 6:
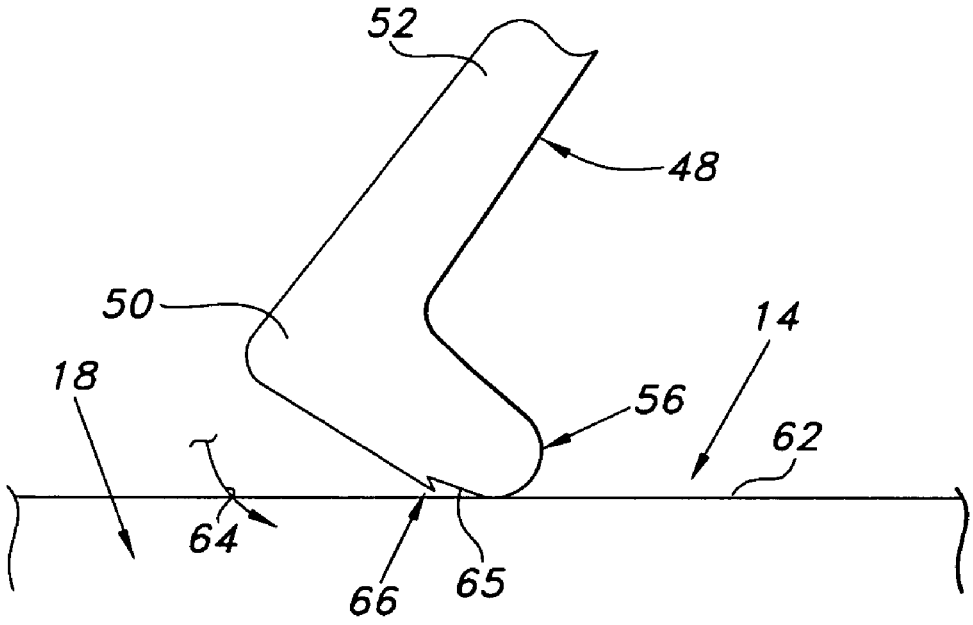
FIG. 6 is a partial side view of the dispenser of FIG. 4, showing the position of the toe and pick of the sheet mover relative to the top sheet of the stack of sheet material as the toe moves across the stack to position the pick in a position to engage the top sheet.
Figure 7:
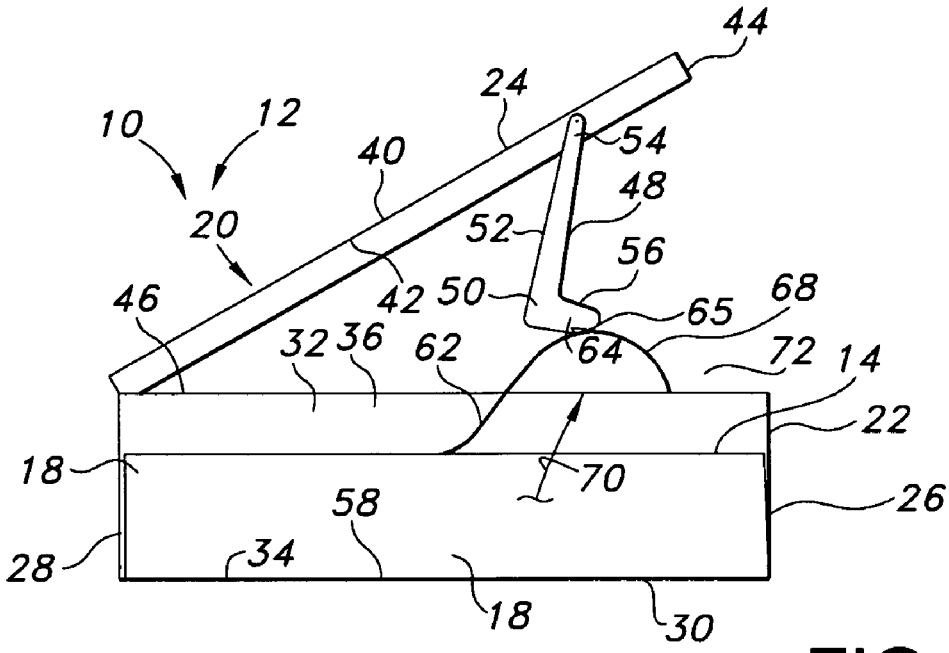
FIG. 7 is a side sectional view of the dispenser of FIGS. 1-4, but showing the engagement of the pick on the toe of the sheet mover to the top sheet, lifting the top sheet as the lid of the dispenser is lifted upward.
Figure 8:
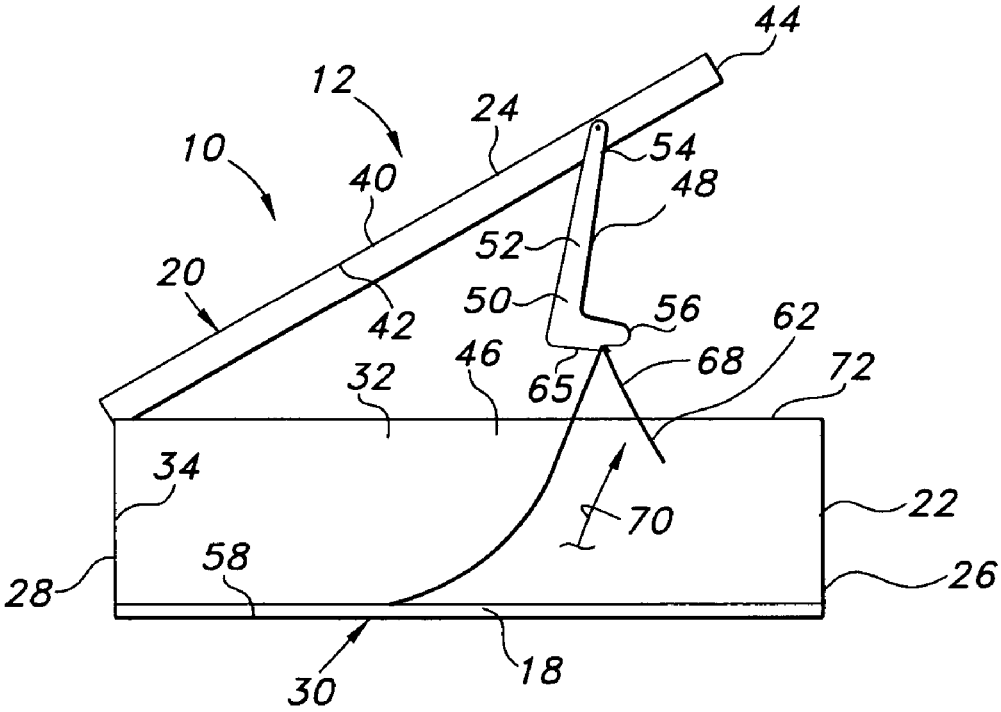
FIG. 8 is a side sectional view of the dispenser of FIGS. 1-4, but showing another aspect of the engagement of the pick on the toe of the sheet mover to the top sheet, lifting the top sheet as the lid of the dispenser is lifted upward.
Figure 9:
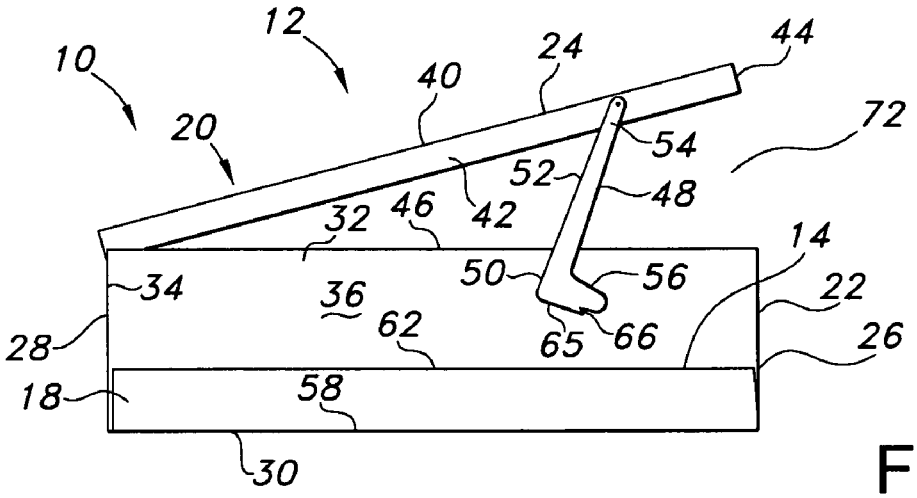
FIG. 9 is a side sectional view showing the position of the sheet mover after the top sheet has been removed from the pick of the sheet mover.
Figure 10:
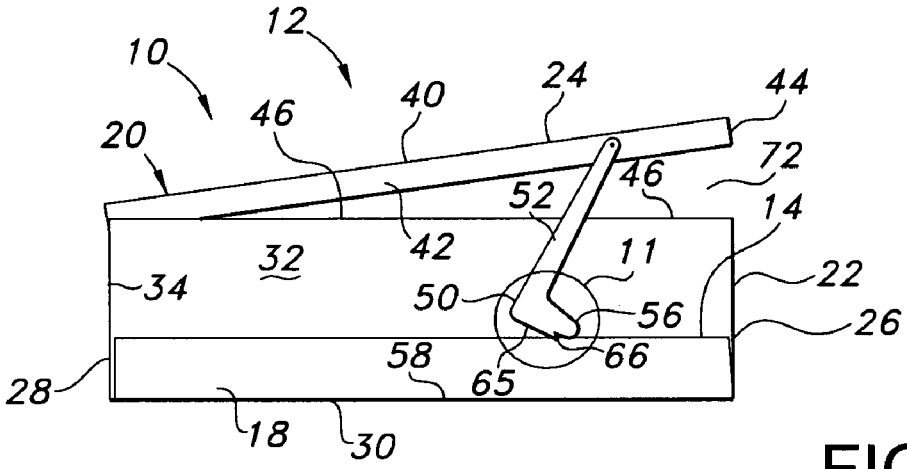
FIG. 10 is a side sectional view showing the position of the pick and toe on the sheet mover as the pick engages the top sheet of sheet material when the lid is lifted.
Figure 11:
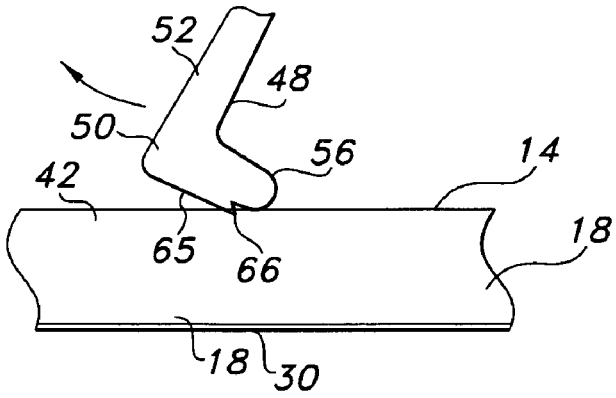
FIG. 11 is a partial side view of FIG. 10, showing the engagement of the pick on the toe of the sheet mover as the pick engages the top sheet.
Figure 12:
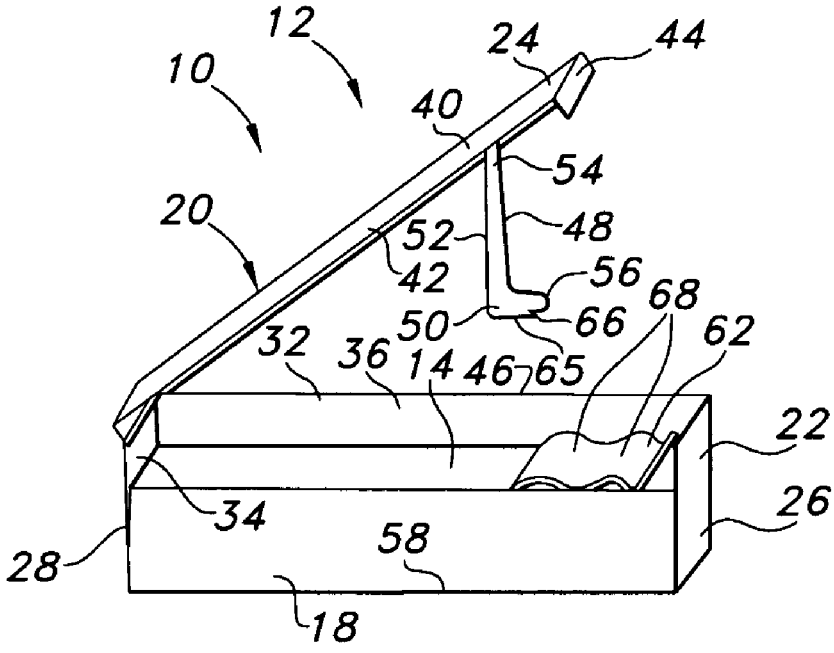
FIG. 12 is a perspective sectional view of the dispenser of FIGS. 1-11, but showing a sheet mover which ruffles and wrinkles a portion of the top sheet of material away from a remainder of the stack of sheet materials providing a portion created in the ruffle/wrinkle that may be grasped by a user or by an implement.
Figure 13:
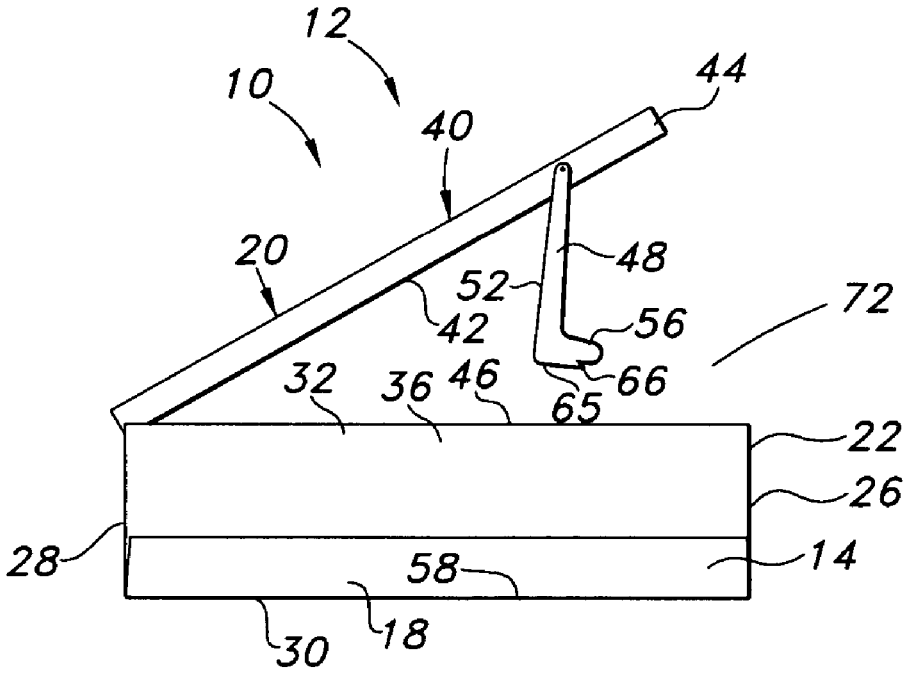
FIG. 13 is a sectional view of the dispenser of FIG. 12, showing the position of the sheet mover, lid and tray container.
Figure 39:
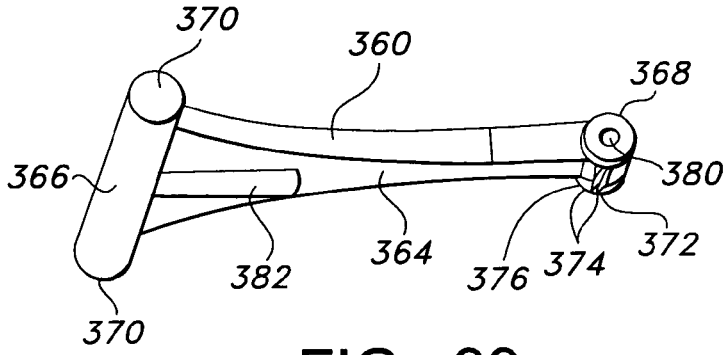
FIG. 39 is a perspective view of another surface of the sheet mover.
Figure 40:
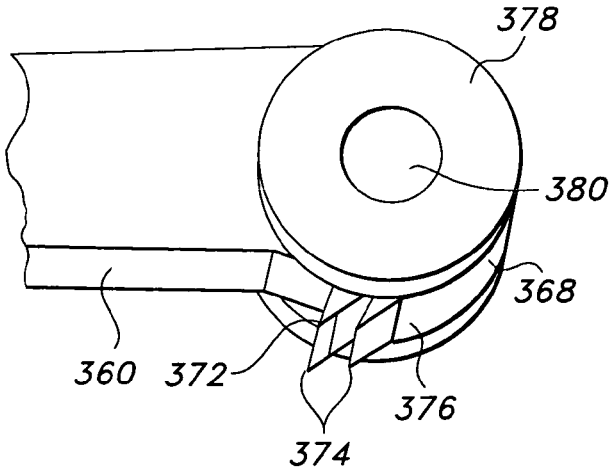
FIG. 40 is a partial perspective view of the toe, pick and teeth of the sheet mover of FIGS. 38 and 39.
Figure 41:
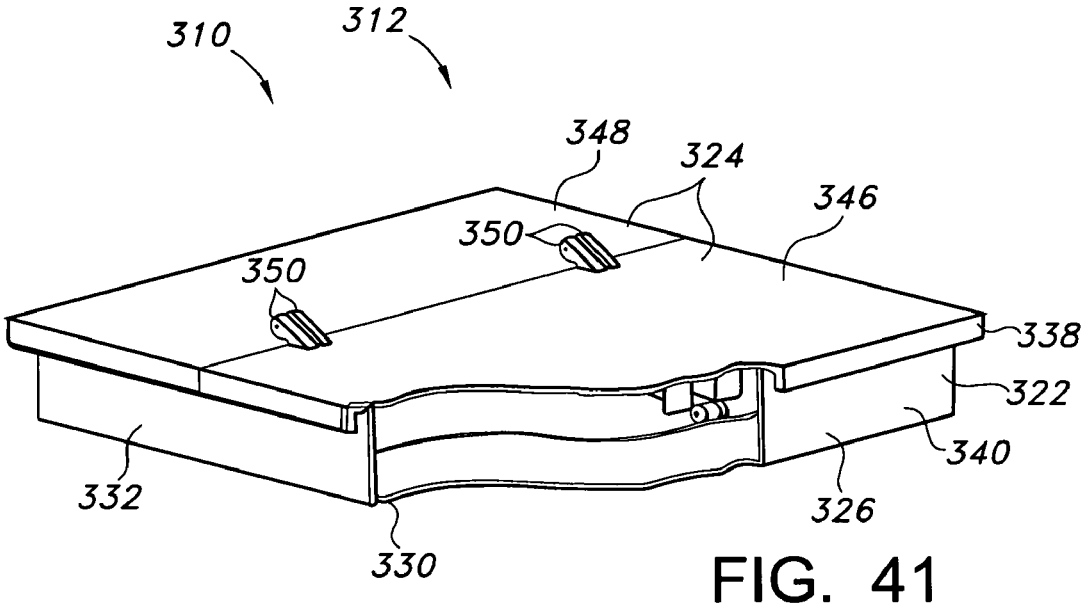
FIG. 41 is a perspective view of the dispenser of the present embodiment, showing a corner and a portion of a front wall cut-away for illustrative purposes only to show the position of the sheet mover when the dispenser is in a closed, non-dispensing position.

When the stack 18 of sheet materials 14 (or, alternatively, a cartridge 16 including the stack 18 of sheet materials 14 therein) is positioned in the tray container 22 and the lid 24 is positioned in a closed dispensing position relative to the tray container 22, the elongated portion 52 of the pivotal leg 48 is desirably positioned near or against a lower surface 42 of the lid 24, as shown in FIG. 3. The toe 56 is desirably positioned against a top sheet 62 in the stack 18 of the sheet material 14. As illustrated in FIGS. 1, 2 and 4, the pivotal leg 48 and foot 50 are urged or biased in a direction 64 especially when the lid 24 is lifted. Such biasing is accomplished by use of, for example, but not by way of limitation, a spring, an )-ring, a band, weights, magnets, geometry and mass of pivotal leg, and so forth (not shown). When the lid 24 is lifted in an opened, dispensing position, as shown in FIG. 4, a lower surface 65 of the toe 56 is positioned against the sheet material 14. As illustrated best in FIGS. 5, 8, 10 and 11, the lower surface 65 of the toe 56 includes one tooth, or, alternatively, two or more teeth (illustrated, for example, in FIGS. 39 and 40) which act as a pick 66 (only one tooth or pick 66 is shown). As the toe 56 moves across a top sheet 62 in the stack 18 of sheet materials 14 when the lid 24 is lifted, the pick 66 moves against the top sheet 62 to grab, snag or pick up the top sheet 62 from the stack 18 of sheet materials 14, as shown in FIGS. 7, 8, 10 and 11. Desirably, the pick 66 is configured to snag, grab or pierce the top sheet 62 without tearing or creating any significant aperture or opening in the top sheet 62. As the lid 24 is opened further, as illustrated in FIGS. 7 and 8, a portion 68 of the top sheet 62 is lifted substantially upward for presentation to a user and easy removal by a user. Alternatively, as illustrated in FIG. 12, the top sheet 62 is pushed or wrinkled upward and/or away from the stack 18 for similarly easy withdrawal and removal from the dispenser 12.

In this alternative, the top sheet 62 is pushed to cause at least one portion 68 of the top sheet 62 of the sheet material 14 to lift up and/or to move away in a direction 70 (FIGS. 7 and 8) from the remaining stack 18 of sheet material 14. The top sheet 62, however, is not snagged, grabbed or attached to the pick 66 or the toe 56 of the pivotal leg 48, as shown in FIGS. 7 and 8. The pick 66 and/or toe 56 may be modified to create friction against at least the portion 68 of the top sheet 62 without snagging or otherwise attaching itself to the top sheet 62. That is, the pick 66, toe 56 and/or any portion of the leg 48 may be formed to rub, bunch, push and/or move a portion 68 of the top sheet 62 upward and/or away from the remainder of the stack 18, as shown in FIG. 12. In this manner, the pick 66, if any, and/or the toe 56 may include a material, such as, for example only, rubber, plastic, metal, and so forth and/or be formed with frictional characteristics which would cause sufficient friction against the top sheet 62 to cause bunching, gathering and/or movement of the top sheet 62. Therefore, the toe 56 may be provided without a pick 66 (not shown). The toe may include one or more ridges, raised portions, and so forth, to provide friction against the top sheet 62 (not shown). In this way, the top sheet 62 presents itself to be removed from the dispenser 12 by a user, who would likely, but not by way of limitation, grasp the top sheet 62 between the user's thumb and first finger to do so. Alternatively, however, the top sheet 62 may be grasped by any appropriate implement to be removed from the dispenser 12. Such implements may include, but are not limited to, forceps, tongs, tweezers and so forth. The opening into the internal compartment 36 provided by lifting the lid 24 provides the exit port 72 for removal of sheet materials 14 from the dispenser 12.

It will be understood that the top sheet 62 is the uppermost sheet or the sheet situated closest to the exit port 72 in the stack 18 of sheet materials 14 in the dispenser 12. When the top sheet 62 is removed, the sheet nearest and usually, but not by way of limitation, underneath the top sheet 62, becomes the new top sheet. This process desirably continues until all sheet materials 14 are removed or withdrawn from the dispenser 12.

After the top sheet 62 is removed by a user via the method and apparatus shown in FIGS. 1-12, the forward movement of the pivotal leg 48 is limited in the direction 64 to facilitate closing the lid 24 of the tray container 22, as shown in FIG. 13 and FIGS. 1-3. The pivotal leg 48 moves in an opposite direction 74 which permits contact of the smooth toe 56 with the new top sheet 62, and moves the pick 66 away from the top sheet 62, as illustrated best in FIGS. 2 and 3. The pivotal leg 48 desirably moves backward in the direction 74 which permits the elongated portion 52 of the pivotal leg 48 to again move closer or adjacent the lower surface 42 of the lid 24, to facilitate lifting the new top sheet 62 when the lid 24 is again lifted to permit dispensing from the dispenser 12.

Figure 14:
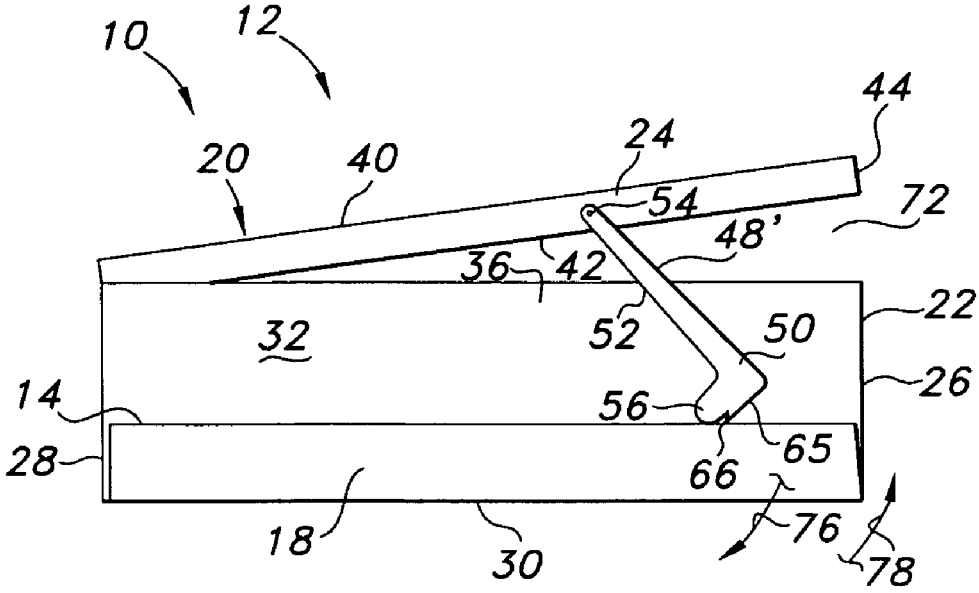
FIG. 14 is a sectional view of a dispenser similar to the dispenser of FIGS. 1-13, but showing the sheet mover turned 180 degrees in an opposite direction; the toe of the sheet mover moving across the top sheet such that the pick is positioned to engage the top sheet.
Figure 15:
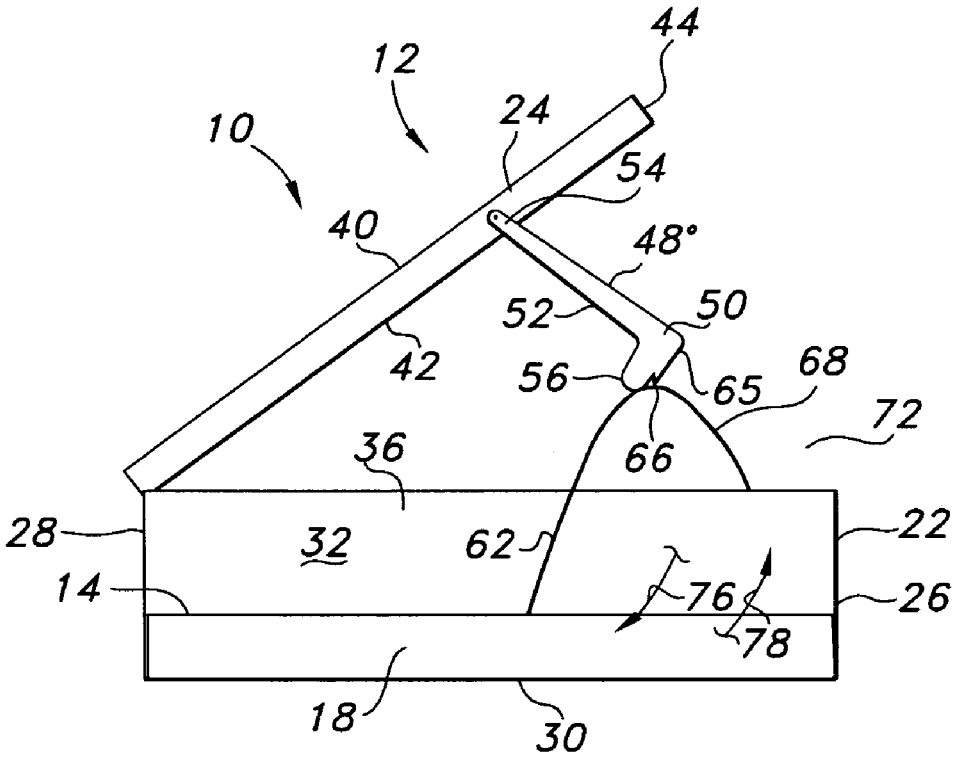
FIG. 15 is a sectional view of the dispenser of FIG. 14, but showing the pick on the toe of the sheet mover as it lifts the top sheet away from the stack as the lid is moved upward and away from the tray container such that the top sheet is positioned to be removed by a user.

FIGS. 14 and 15 illustrate the system 10 and dispenser 12 of FIGS. 1-13, except that the pivotal leg 48' however, is positioned at a 180 degree angle relative to the pivotal leg 48 shown in FIGS. 1-13. That is, the pivotal leg 48' is turned the opposite direction relative to the leg 48 shown in FIGS. 1-6. The leg 48' is urged in a direction 76 when the lid 24 is lifted so that a pick 66 will snag, grab or pick up the top sheet 62 of sheet material 14 from the stack 18. In this instance, however, the leg 48' is urged in the direction 76 via gravity; no biasing apparatus is required. Biasing apparatus, such as, for example only, a spring, O-ring, bands, weights, magnets, and so forth may be used to increase or enhance the action of the leg 48'. When the lid 24 is closed, the toe 56 and foot 50 are moved in a direction 78 so that the mid-portion 52 and leg 48' are moved adjacent the lower surface 42 of the lid 24.

Figure 16:
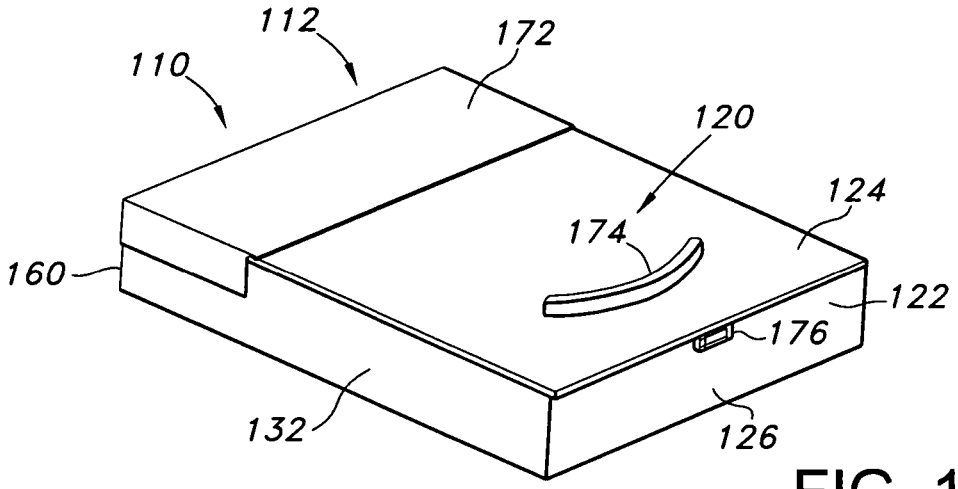
FIG. 16 is a perspective view of another embodiment of the system and dispenser, the dispenser positioned in a closed, non-dispensing position and the housing including a lid and a tray container.

In another embodiment of the invention, the system 110 and the dispenser 112 are similar to the system 10 and dispenser 12 shown in FIGS. 1-15 and described in detail herein. As illustrated in FIGS. 16-33, the system 110 includes a dispenser 112 having a dispenser housing 120 which includes a tray container 122 and a cover or lid 124. As shown in FIGS. 16 and/or 17, the tray container 122 includes a front wall 126 and a back wall 128 which are spaced apart and intersect a lower end 130. A pair of spaced-apart side walls 132 are also intersect the lower end 130, and extend a distance beyond the back wall 128. The side walls 132 cooperate with the front and back walls 126, 128 to provide an inner surface 134 in which an internal compartment 136 is provided. The inner surface 134 and the internal compartment 136 formed thereby are configured to receive and hold sheet materials 14 or a cartridge 16 of sheet materials 14 therein.

The tray container 122 may include at least one, and desirably a pair of curved spring members 138. Each spring member 138 is desirably positioned in a groove 140 formed in an upper edge 142 of each side wall 132. Each spring member 138 may, at one end, be coupled to the upper edge 142 of the side wall 132 (not shown). The opposite, free end 144 of each spring member 138 curves upward in its unrestrained position, as shown best in FIGS. 30 and 31, to assist in lifting at least a portion of the lid 124. When restrained (when the lid 124 is in a closed position, the free end 144 is biased to rest within its respective groove 140 (not shown).

Turning back to FIGS. 17, 22 and 23, a rear portion 146 of the tray container 122 extending beyond the back wall 128 includes a recessed surface 148 coupled to the back wall 128 and the side walls 132 which is recessed lower than the upper edge 142 of the side walls 132 and an upper edge 150 of the back wall 128. An extension 152 extends from the upper edge 150 of the back wall 128, between the upper edges 142 of the sidewalls 132, and generally is in a planar alignment therewith (FIGS. 22-25). In addition, each sidewall 132 includes a recessed portion 154 which is positioned on an outer surface 156 of each sidewall near a junction of the sidewall 132 and the back wall 128. The recessed portion 154 may extend, but not by way of limitation, to each end 160 of each side wall 132. A spring 162 is provided which is configured to be positioned over at least a portion of the extension 152.

The lid 124 may include a movable first lid section 164 and a second lid section 166 which may be pivotably coupled together by a hinge, desirably, in this embodiment, a living hinge 168. The lid 124 includes a perimeter edge 170 which extends about a perimeter of the first and second lid sections 164, 166. A lid retainer 172 (FIGS. 16, 17 and 21) also may be provided, and it cooperates with the lid 124 to permit the lid 124 to be opened and closed. The first lid section 164 desirably may include a handle 144. Alternatively, the lid 124 may include a pull, knob, indentation, or other apparatus provided with or formed in the lid to permit the lid to be pulled, moved and/or lifted.

The lid 124 and tray container 122 may include a latch assembly to releasably lock the dispenser housing 122 in a closed position. The latch assembly desirably includes a latch 176 and a lip 178. The latch 176 is desirably formed at an angle with respect to the perimeter edge 170 of the lid 124. The latch 176 includes an opening 180 formed therein which cooperates with the lip 178 positioned on an outer surface 182 of the front wall 126 of the tray container 122. The latch 176 slides over the lip 178 and the lip 178 extends into the opening 180 of the latch 176 to releasably hold the dispenser housing 120 in a closed, non-dispensing position. Such a position reduces or prevents moisture contained in the dispenser housing 120 from evaporating.

A pivotal leg 184 illustrated in FIGS. 18, 19, 30 and 31 is desirably coupled to a lower surface 186 of the first lid section 164. The pivotal leg 184 includes an elongated portion 188 having at one end a rounded bar 190 which is configured to be pivotably coupled to the lower surface 186 of the first lid section 164, to permit pivotable movement of the leg 184. At the opposite end, the pivotal leg 184 includes a toe 192 which may include a pick 194 comprising one or more teeth 196 on a lower surface 198 thereof.

Figure 17:
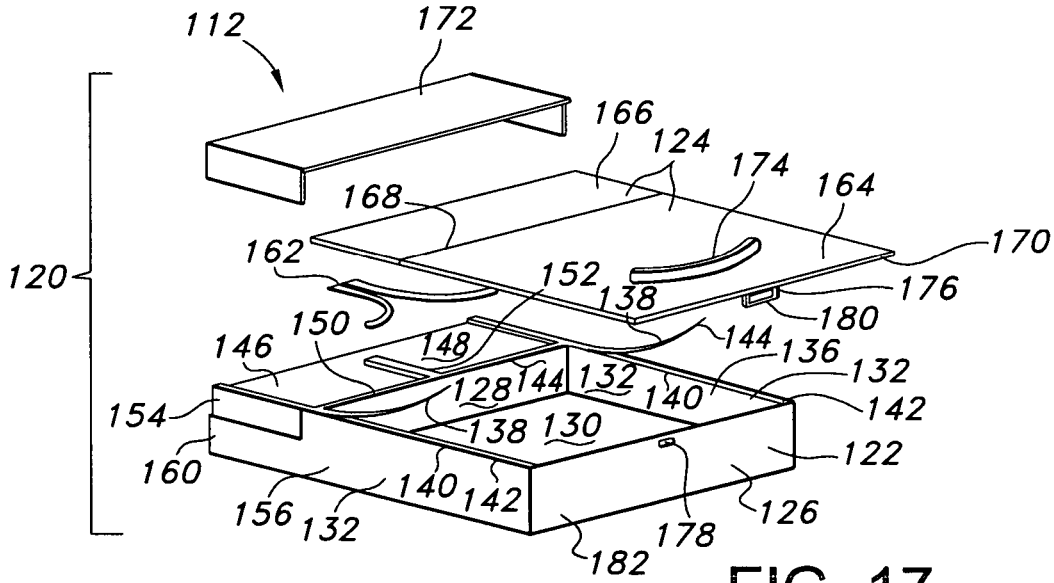
FIG. 17 is an exploded perspective view of the dispenser of FIG. 16, showing some of the components of the dispenser.
Figure 18:
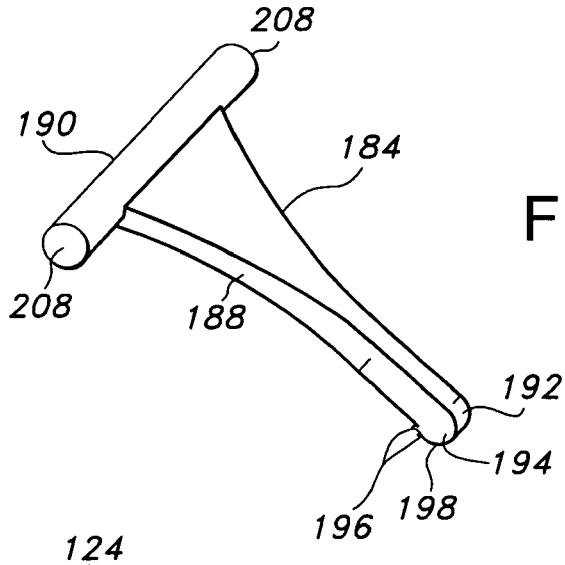
FIG. 18 is a perspective view of the sheet mover of the present embodiment.
Figure 21:
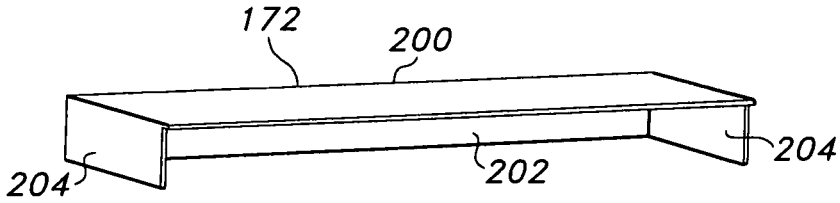
FIG. 21 is a perspective view of the lid retainer of FIGS. 16 and 17.
Figure 22:
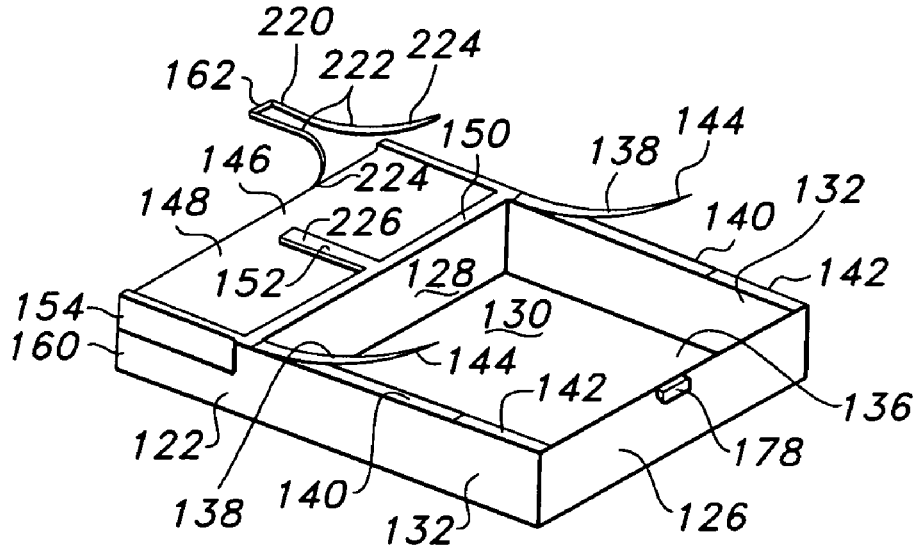
FIG. 22 is a perspective view of the tray container of the dispenser, showing a spring and the spring members positioned on an edge of each side wall of the tray container.
Figure 23:
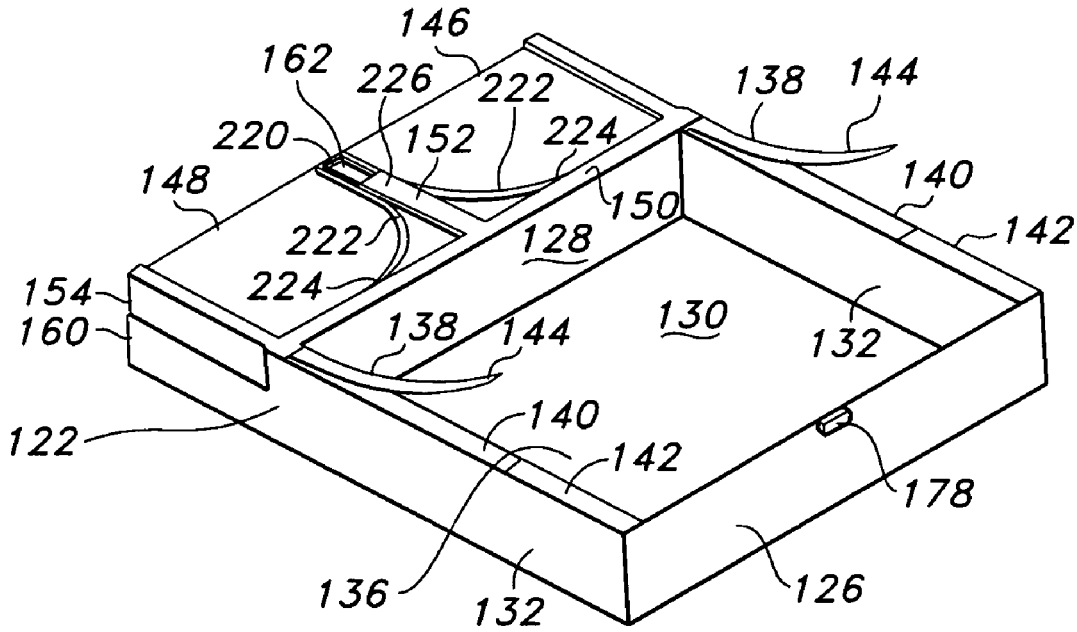
FIG. 23 is a perspective view similar to FIG. 22, but showing the spring positioned about an extension on the tray container.

The lid retainer 172 shown in FIGS. 16, 17 and 21 is desirably configured to have an upper wall 200 intersected by a back wall 202 and by a pair of spaced-apart side walls 204. The lid retainer 172 is desirably positioned over a portion of the second lid section 166 and the sidewalls 204 fit into the recessed portions 154 of each side wall 132 on the rear portion 146 of the tray container 122.

Figure 19:
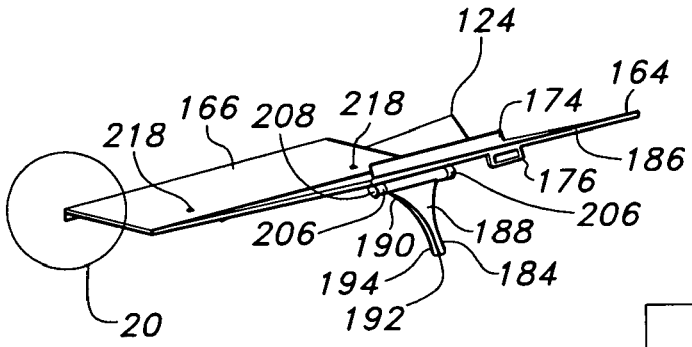
FIG. 19 is a perspective view of the lid of the dispenser of FIGS. 16 and 17, showing the first and second lid sections and the sheet mover coupled thereto.
Figure 20:
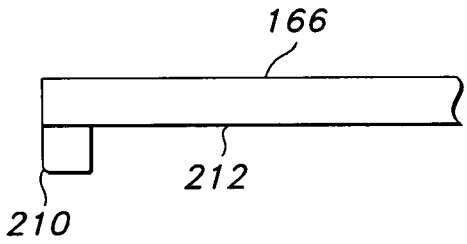
FIG. 20 is a partial side view of FIG. 19 taken along line 20.
Figure 30:
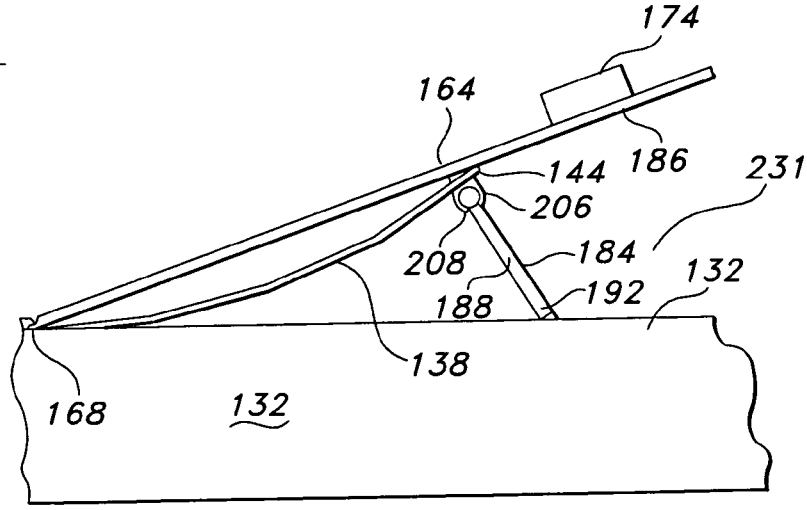
FIG. 30 is a side view of the dispenser of FIG. 28 and 29, showing the position of the first lid section, the spring members and the sheet mover.

The pivotal leg 184 is desirably pivotably coupled to a lower surface 186 of the first lid section 164 via a pair of loop members 206, as shown in FIGS. 19 and 30. The loop members 206 are desirably coupled to the lower surface 186 of the first lid section 164, and they pivotably couple each end 208 of the rounded bar 190 to the lower surface 186 of the first lid section 164 to permit at least some pivotable movement of the leg 184. The second lid section 166, as illustrated in FIGS. 19, 20, 24 and 25, desirably includes a rear flange 210 coupled to or formed with a lower surface 212 of the second lid section 166 adjacent a back portion 214 of the perimeter edge 170. This rear flange 210 is positioned to push against a portion of the spring 162 which facilitates closing the lid 124. An upper surface 216 of the second lid section 166 includes one or more (a pair is illustrated) locking protrusions 218, shown in FIGS. 19, 26 and 27, which act to lock the lid 124 in a forward, opened, dispensing position, as will be described in further detail below.

The spring 162, as illustrated in FIGS. 22-25, includes a middle bar 220 having a pair of spread-apart arms 222 attached thereto. The arms 222 each have a free end 224 which extend away from each other. As noted previously, the spring 162 is positioned on the recessed surface 148 and over the extension 152 and the arms 222 and free ends 224 are positioned against a portion of the back wall 128 while the middle bar 220 may be positioned, at times, against a free end portion 226 of the extension 152 to facilitate closing the lid 222.

Figure 24:
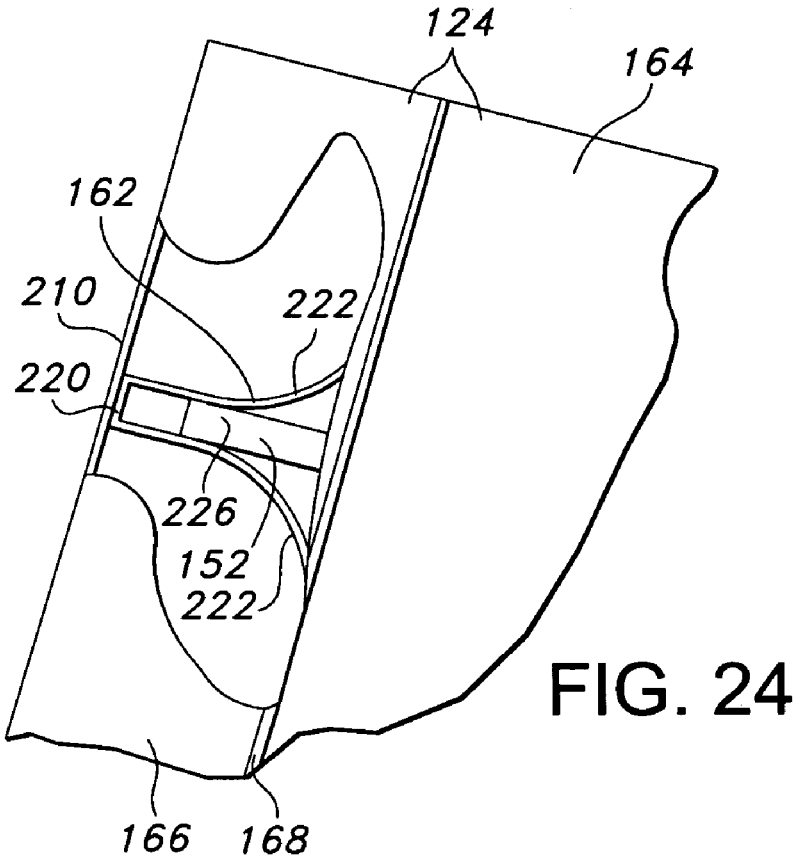
FIG. 24 is a partial perspective view of the dispenser of FIG. 16, but showing a cut-away section in the lid retainer and second lid section which discloses the closed, non-dispensing position of the lid and spring at rest.
Figure 25:
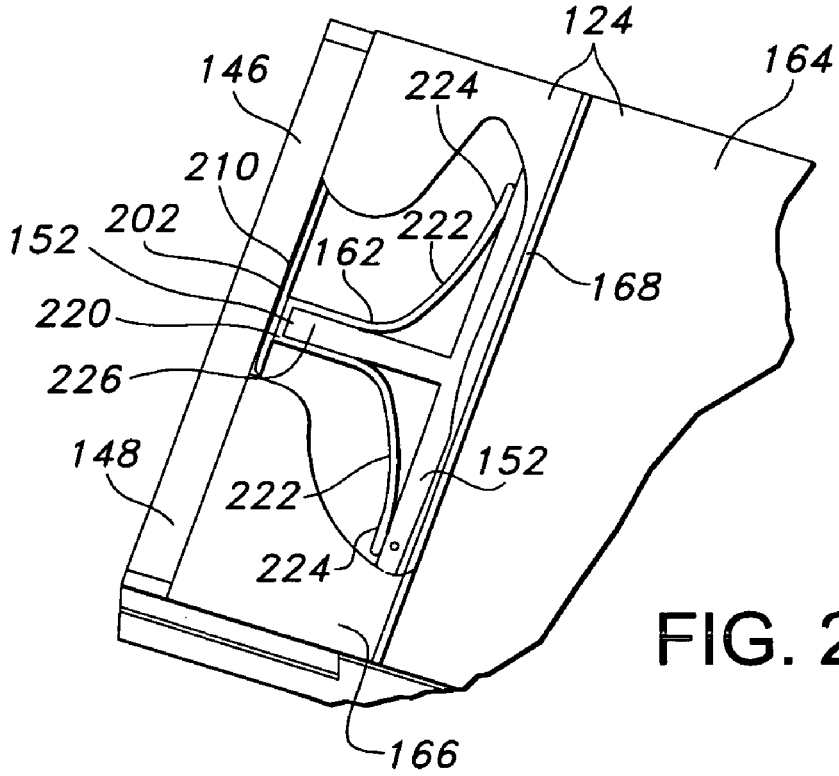
FIG. 25 is a partial perspective view of the dispenser of FIGS. 16 and 24, but showing a cut-away section in the lid retainer and second lid section which discloses the open, dispensing position of the lid and spring under tension.
Figure 26:
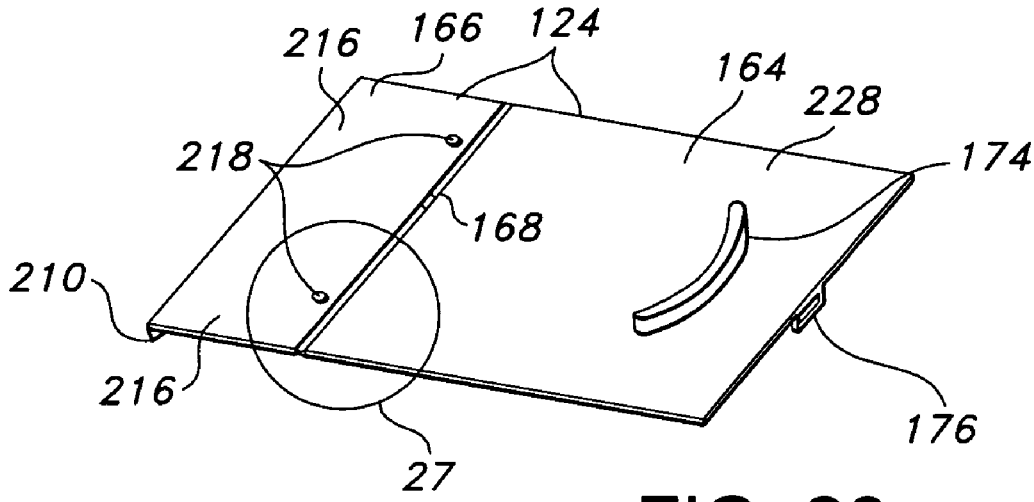
FIG. 26 is a perspective view of the first and second lid sections of the lid of the dispenser of FIG. 16 and 17, showing the position of the hinge and locking protrusions on the lid.
Figure 27:
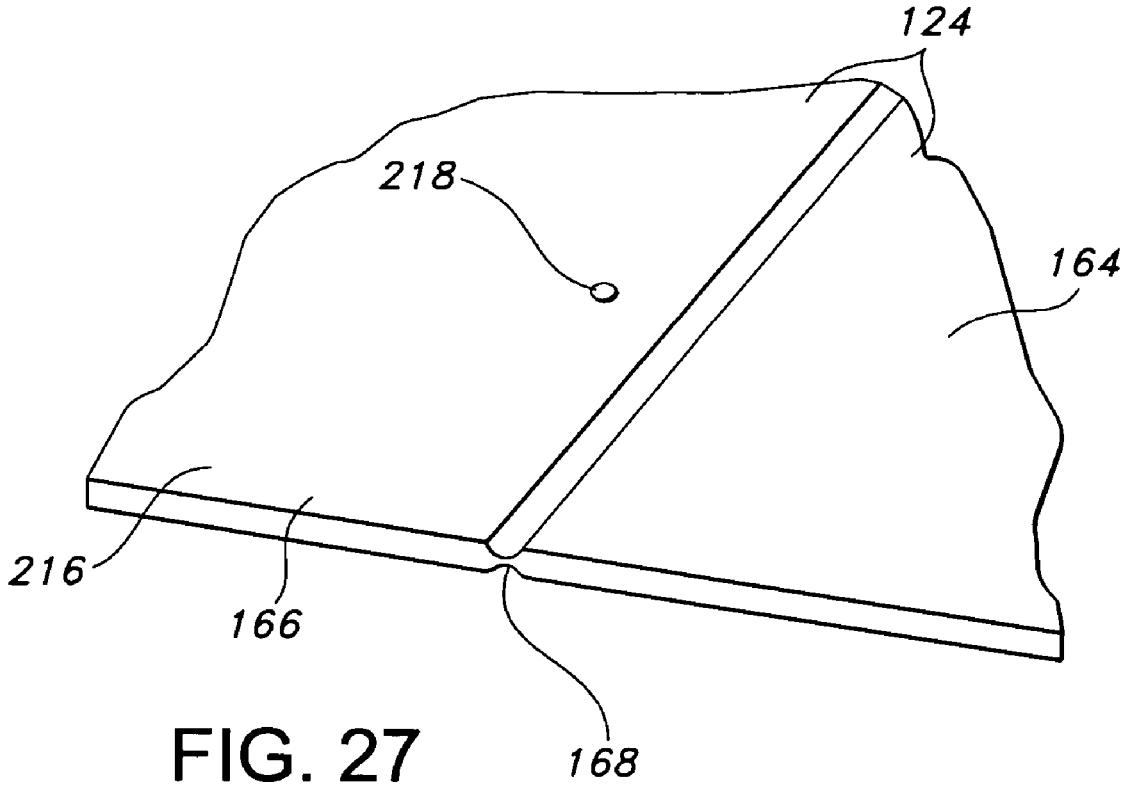
FIG. 27 is a partial perspective view of FIG. 26 taken along line 27.
Figure 31:
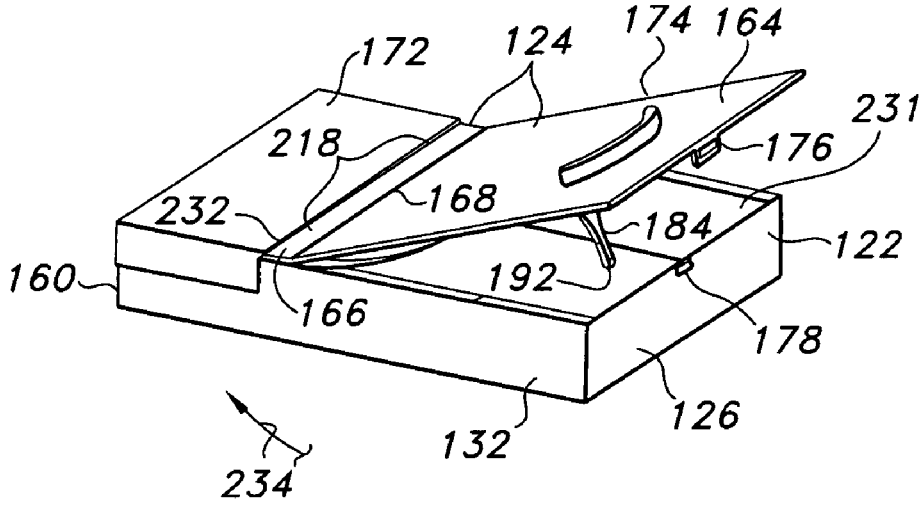
FIG. 31 is a perspective view of the dispenser of FIGS. 28-30, but showing the direction and movement to close and lock the dispenser.

The lid 124 is in a closed, non-dispensing position when the middle bar 220 of the spring 162 is pushed away from the free end portion 226 of the extension 152 as illustrated in FIG. 24. The spring 162 is biased, however, when the lid 124 is positioned in a raised, opened position, and the middle bar 220 is positioned against the free end portion 226 of the extension 152 via the rear flange 210 of the lid retainer 172, as shown in FIGS. 25 and 30-31, while the free ends 224 of the arms 222 of the spring 162 push against a portion of the back wall 128. That is, when the handle 174 on an outer surface 228 of the first lid portion 164 is moved in a direction 230 forward, the latch 176 moves forward, away from the lip 178 and the spring members 138 push against the lower surface 186 of the first lid section 164 of the lid 124 in order to raise the first lid section 164 upward, as illustrated in FIGS. 28-31. The lid 124 is desirably moved forward in the direction 230 until at least the hinge 168 and a portion of the second lid section 166 is exposed from underneath the lid retainer 172. The lid 124 is maintained in a raised position by moving it forward until the locking protrusions 218 are moved from underneath the lid retainer 172 and positioned against an edge 232 of the lid retainer 172. This action prevents the spring 162 from moving the lid 124 in a backward direction 234 thereby closing the lid 123 (FIGS. 32 and 33).

When the first lid section 164 is moved forward and raised by the spring members 138 into an opened, dispensing position, the pivotal leg 184 simultaneously moves. The toe 192 is moved against the top sheet 62 in the stack 18 of sheet materials 14, as shown in FIGS. 31 and as shown and described in detail previously herein in other embodiment(s). The pick 194 moves over the top sheet 62 to snag or grab the top sheet 62 so that as the first lid section 164 of the lid 124 is lifted, the top sheet 62 is held by the pick 194 and presented to a user to remove from an exit port 231 provided by the opened dispensing position (FIGS. 30 and 31) as shown best in FIGS. 7 and 8, and as previously described herein. Alternatively, the toe 192 does not include a pick and pushes at least a portion of the top sheet such that the portion is moved away from the remaining adjacent sheet materials for withdrawal from the dispenser, as previously shown in FIG. 12.

Figure 28:
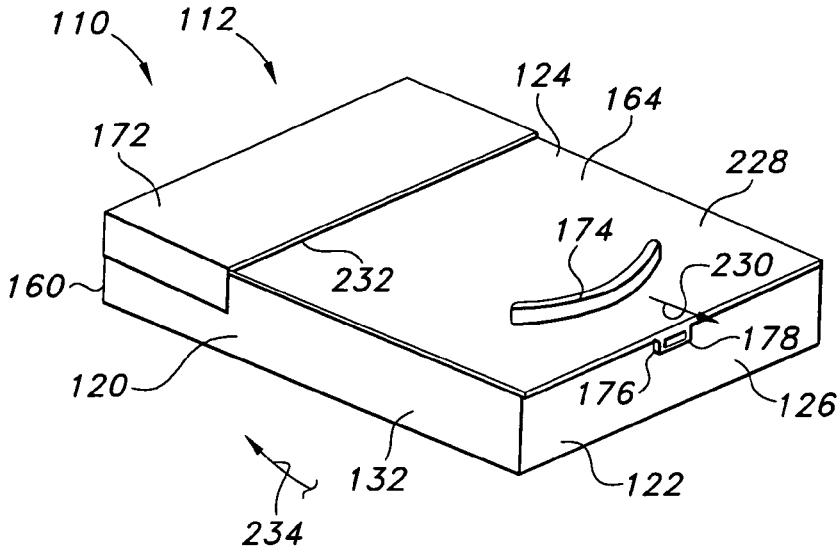
FIG. 28 is a perspective view of the dispenser similar to FIG. 16, showing the movement of the lid to permit an opening of the dispenser for dispensing.
Figure 29:
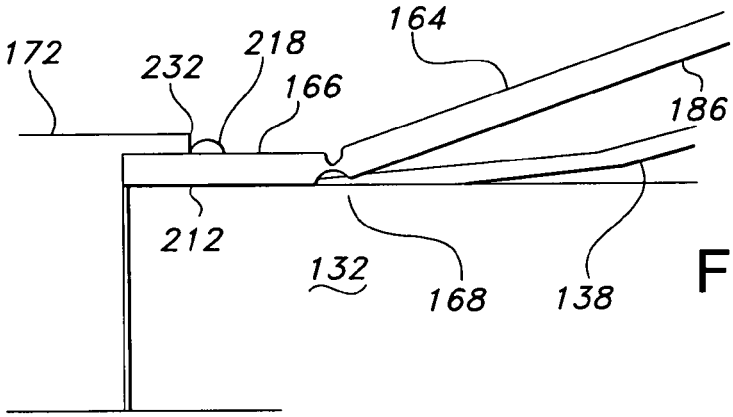
FIG. 29 is a side view of the dispenser of FIG. 28, showing the movement of the lid forward, the lid retained in a forward, opened position by the positioning of the locking protrusions and the spring members.
Figure 32:
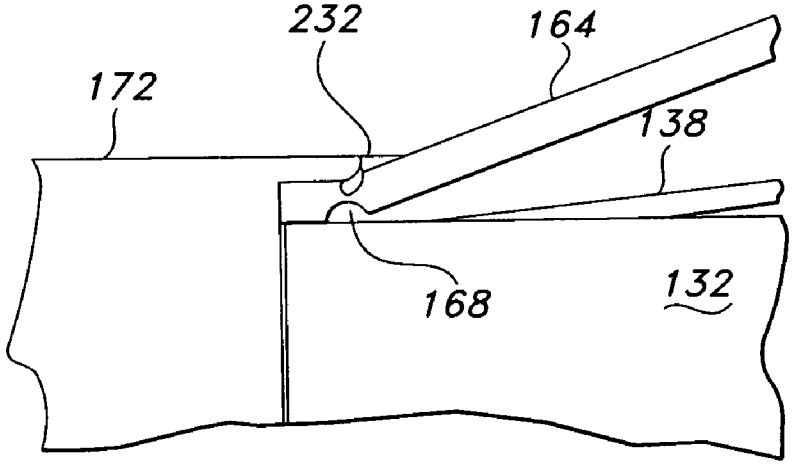
FIG. 32 is a partial side view of the dispenser of FIG. 31, showing the edge of the lid retainer moving over the hinge.
Figure 33:
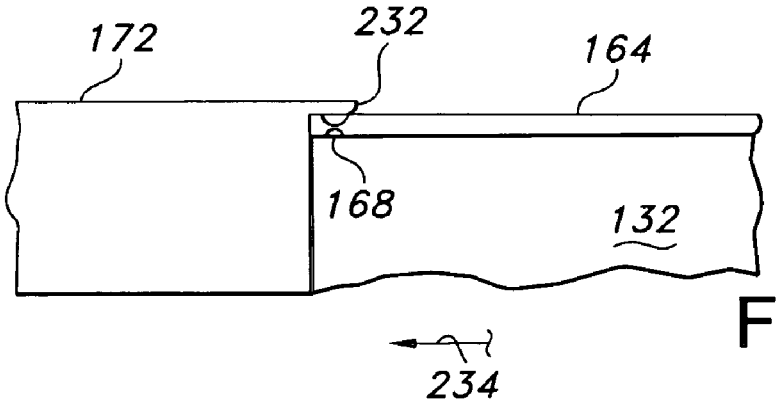
FIG. 33 is a partial side view of the dispenser of FIG. 31, showing the edge of the lid retainer urging the first lid section down, against an edge of the tray container to position the dispenser in a closed position, as shown in FIG. 28.

To close the lid 124, the first lid section 164 is moved downward and moved backward in a direction 234 such that the protrusions 218 on the second lid section 166 and the hinge 168 move under the edge 232 of the lid retainer 172 which urges the first lid section 164 in a downward direction 236, as shown in FIGS. 32 and 33. This movement also pushes spring members 138 back into their grooves 140, so that the first lid section 164 is permitted to close over the opening and access it provides to the tray container 122. To hold the first lid section 164 in a closed position against a perimeter edge 238 of the tray container 122, the latch 176 moves such that the lip 178 extends into the opening 180 of the latch 176 to hold the lid 124 in a closed position to reduce or prevent evaporation of any moisture from the tray container 122, as illustrated in FIG. 28.

Figure 34:
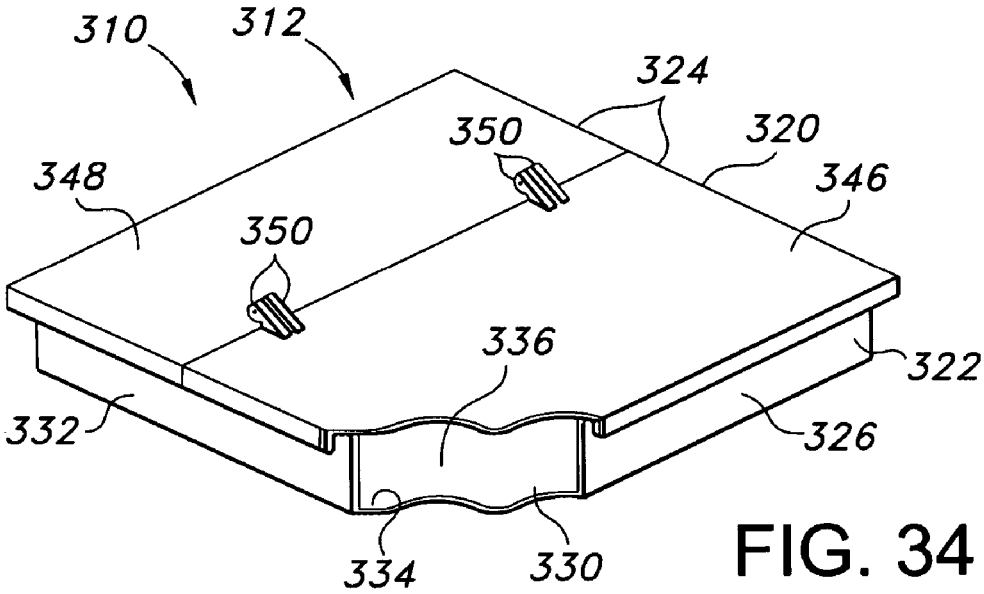
FIG. 34 is a perspective view of still another embodiment of the present invention, the dispenser positioned in a closed, non-dispensing position and the housing including a lid and a tray container, a corner cut-away for illustrative purposes only to show the closure of the lid over the tray container.
Figure 35:
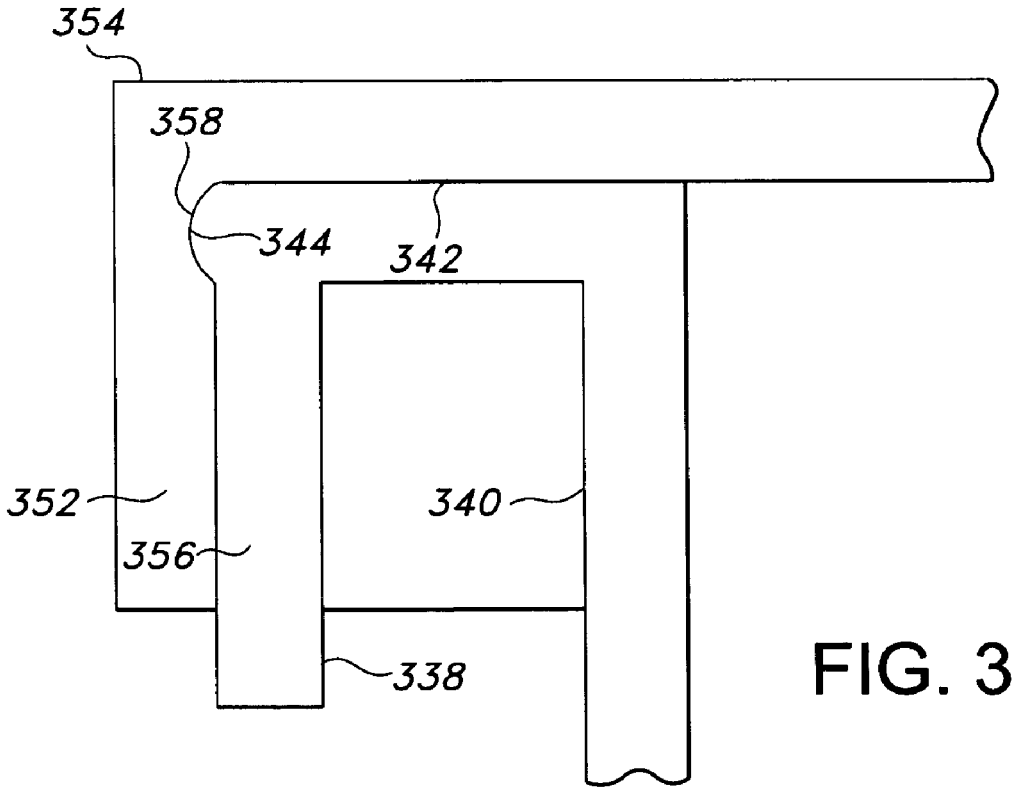
FIG. 35 is a side sectional view of the dispenser of FIG. 34, showing a rib in the L-shaped flange formed about an edge of the tray container in contact with a groove in the lid.
Figure 36:
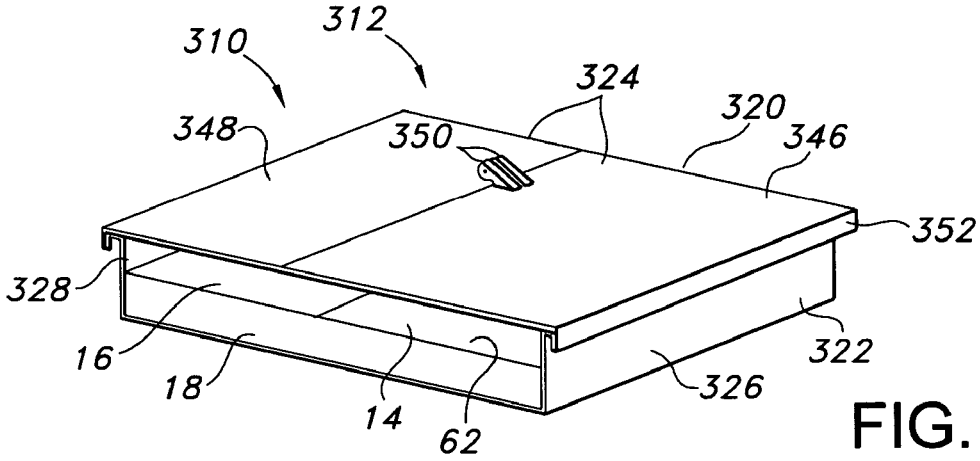
FIG. 36 is a partial perspective view of the dispenser of FIGS. 34 and 35, showing the position of a cartridge in the container.
Figure 37:
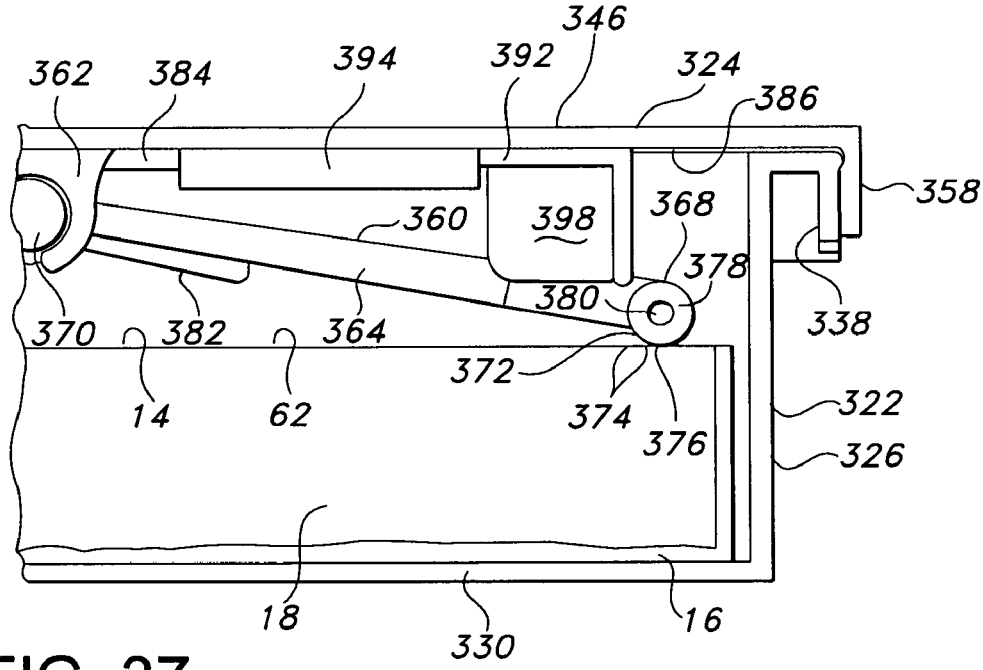
FIG. 37 is a partial sectional view of the dispenser of FIGS. 34 and 36, but showing a non-dispensing position of a sheet mover on a top sheet of the stack of sheet materials in the container.
Figure 38:
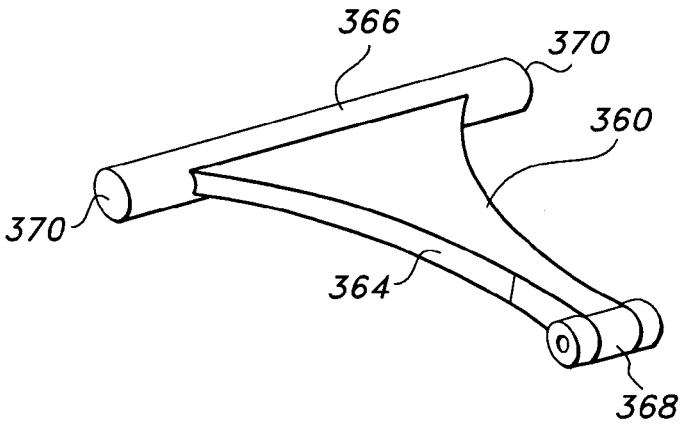
FIG. 38 is a perspective view of one surface of the sheet mover.

In yet another embodiment of the invention, as shown in FIGS. 34-53, the system 310 and the dispenser 312 are similar to the system 10, 110 and dispenser 12, 112 illustrated in FIGS. 1-33 and described in detail herein. The system 310 includes a dispenser 312 having a dispenser housing 320 which includes a tray container 322 and a cover or lid 324, as shown in FIGS. 34-36. The tray container 322 includes a front wall 326 and a back wall 328 which are spaced apart and intersect a lower end 330. A pair of spaced-apart side walls 332 also intersect the lower end 330 and cooperate with the front and back walls 326, 328 to provide an inner surface 334 which is configured to provide an internal compartment 336 in which a stack 18 of sheet materials 14 are positioned. At least the front wall 326 and desirably the back wall 328 as well as a portion of the side walls 332 include an L-shaped flange 338 which is positioned on at least a portion of an outer surface 340 of the front wall 326 and the side walls 332 adjacent a perimeter edge 342. The L-shaped flange 338 desirably includes a rounded rib 344 which extends about the outer surface 340 thereof.

The lid 324 may include a first lid section 346 which is desirably pivotably coupled to a second lid section 348 via a hinge 350, and so forth, to permit the internal compartment 336 and the sheet materials 14 therein (whether in a stack 18 or in a cartridge 16) to be accessed by a user. The lid 324 may also include an overhanging lip 352 which is formed adjacent a perimeter edge 354 of the lid 324 and extends downward. An inner surface 356 of the lip 352 desirably is formed to include a groove 358 therein which is configured to receive the rib 344 therein.

In this manner, when the lid 324 is closed against the tray container 322, the rib 344 of the tray container 322 is received into the groove 358 which acts to releasably close the dispenser housing 320. In addition, the lip 352 and groove 358 are configured to cooperate to reduce or eliminate moisture from evaporating out of the internal compartment 336 of the dispenser housing 320. To further assist in this closure, a gasket material, such as, for example, but not by way of limitation, a foam, such as, for example only, a closed cell foam material, such as polystyrene, a polyethylene, and so forth, may be used to assist this closure and to provide a seal (not shown). Specifically, a gasket material may be provided adjacent and/or against perimeter edges and other appropriate areas of the tray container 322 and the lid 324, especially the first lid section 346, to further enhance retention of moisture and reduce evaporation in the dispenser housing 320.

The pivotable leg 360, as shown in FIGS. 37-46, is desirably pivotably coupled to the inner surface 334 of the first lid section 346 via a pair of rings 362, which are coupled to the inner surface 334 of the first lid section 346. It will be understood, however, that any apparatus which permits the pivotable leg to operate as described herein may be used. The pivotable leg 360 includes an elongated section 364 having at one end a rounded bar 366 and at an opposite end a toe 368. Each end 370 of the rounded bar 366 is positioned in a ring 362 to provide pivotable movement to the leg 360. The toe 368 includes a pick 372 comprising one or more teeth 374 on a lower surface 376 of the toe 368. A pair of wheels 378 may be rotatably mounted via pins 380 on either side of the toe 368. The wheels desirably stay tangent to the top sheet 62 to permit smooth, even movement of the toe 368 as it rolls over the top sheet 62 to permit the pick 372 to snag or grab the top sheet 62 via the teeth 374 thereon. Alternatively, a single wheel may be mounted centrally on the toe with a portion of the toe positioned on either side of the wheel, each portion desirably including a pick or a pusher positioned thereon (not shown), which is used to pick up (pick) or push and bunch a portion of the sheet material. A ramp 382 may be included on the elongated section 364 of the pivotable leg 360, to limit the pivotable movement of the leg 360. The ramp 382 serves to urge the leg 360 into the shield 384, as will be discussed in further detail below.

Figure 43:
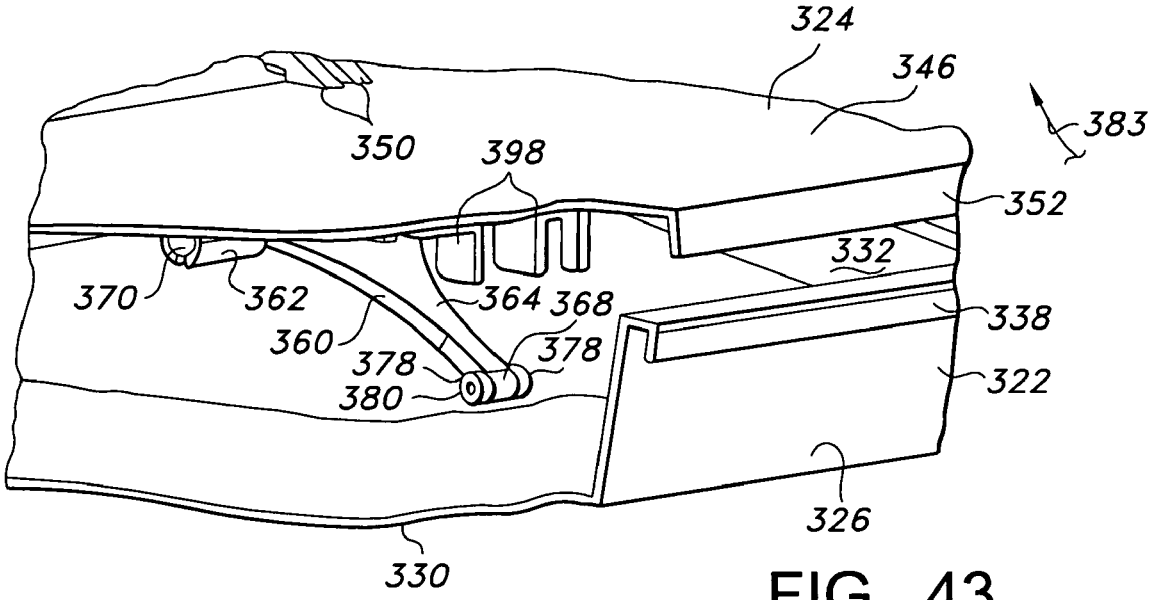
FIG. 43 is another partial perspective view similar to FIG. 42, but showing the lid opening and the position of the toe of the sheet mover.
Figure 44:
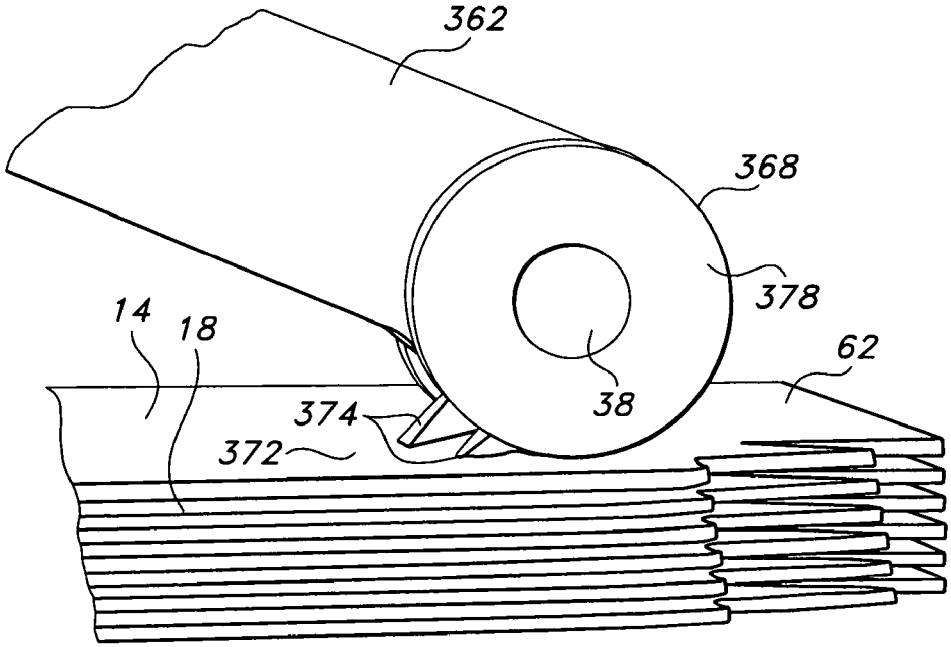
FIG. 44 is another partial perspective view of FIG. 43, showing the pick and teeth of the sheet mover picking the top sheet of material in the stack of sheet materials.
Figure 45:
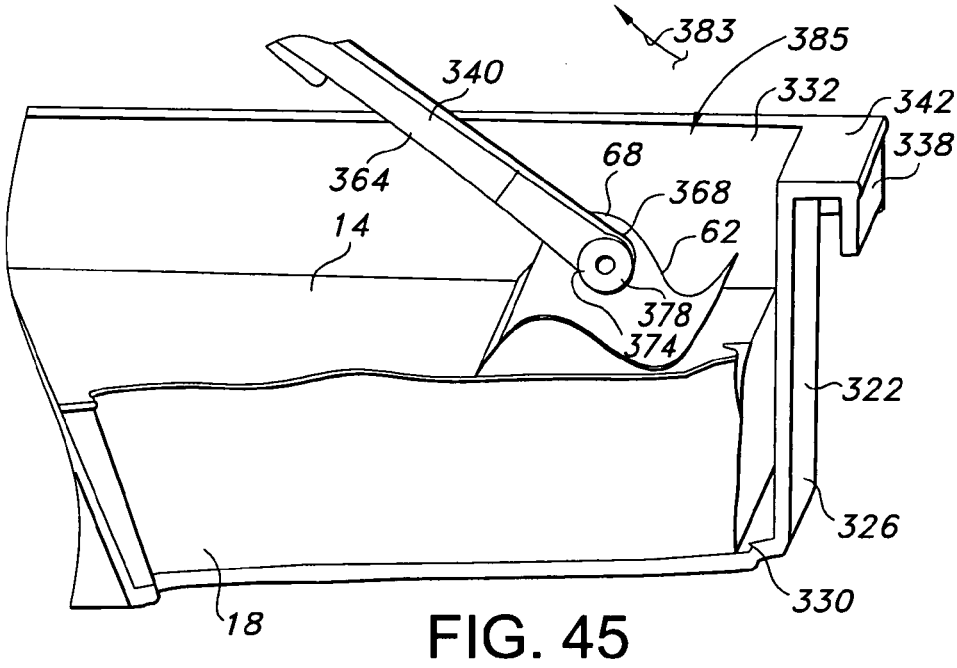
FIG. 45 is a partial perspective view of the present embodiment, showing the pick of the sheet mover moving a portion of the top sheet away from the stack of sheet materials.

As the first lid section 346 is lifted slightly in a direction 383, the wheels 378 roll against the top sheet 62 of the stack 18 of sheet materials 14, as shown in FIG. 43. When the first lid section 346 is lifted higher, providing an exit port 385 the teeth 374 of the pick 372 are moved into a position to snag or grab the first sheet 62, as illustrated in FIG. 44. As the first lid section 346 continues to be lifted in the open dispensing direction 383, the teeth 374 of the pick 372 snag or grab the top sheet 62, as shown in FIG. 45, and lift the top sheet 62 so that it may be grasped, desirably between a thumb and first finger of a user, or by any other method described herein or known by those skilled in the art, for withdrawal from the dispenser 12. As previously noted, the toe 368 may be formed without a pick 372, but the toe 372 may provide sufficient friction against the top sheet 62 to bunch or ruffle the top sheet 62 away from the remaining sheet materials 14 for withdrawal by a user without snagging or grabbing the top sheet.

A shield 384 is desirably included which acts to releasably lock or hold the pivotal leg 360 against a lower surface 386 of the first lid section 346, as illustrated in FIGS. 47-53. Such a shield 384 is useful to prevent movement of the leg 360 when, for instance, inserting sheet materials 14 or a cartridge 16 of sheet materials 14 into the internal compartment 336 of the dispenser housing 320.

The shield 384 desirably includes a central portion 388 having a J-shaped hook 390 at one end and a toe retainer 392 at an opposite end. The shield 384 is coupled adjacent the lower surface 386 of the first lid section 346 via a spaced apart pair of rails 394 which are coupled to the inner surface 386. The rails 394 are positioned in a confronting relationship and each has a groove (not shown) configured to hold an edge 396 on each side of the central portion 388 of the shield 384. The rails 394 permit the shield 384 to movably slide in the rails 394 to hold the pivotal leg 360 in an unmoving shielded position for loading sheet material 14, and so forth. The shield 384 is movable to release the pivotal leg 360 so that the pivotal leg 360 will move actively to dispense sheet materials as described herein.

The toe retainer 392 of the shield 384 desirably includes a pair of spaced-apart and opposing L-shaped flanges 398 which are configured to cooperate to provide a shield for the pick 372. At least a portion of the flanges 398 of the toe retainer 392 are configured to be positioned against each side, that is, in the present embodiment, each wheel 378 of the toe 368 when the leg 360 is positioned in a resting, non-movable position within the shield 384, as illustrated in FIGS. 50-53. In addition, the flanges 398 are also configured to space the toe 368 and pick 372 thereon a distance from an outer edge 402 (FIG. 51 and 52) of each flange 398, so that the pick 372 is prevented from inadvertently picking, grabbing, or snagging sheet materials 14 which are inserted into the internal compartment 336 of the dispenser housing 320.

Figure 42:
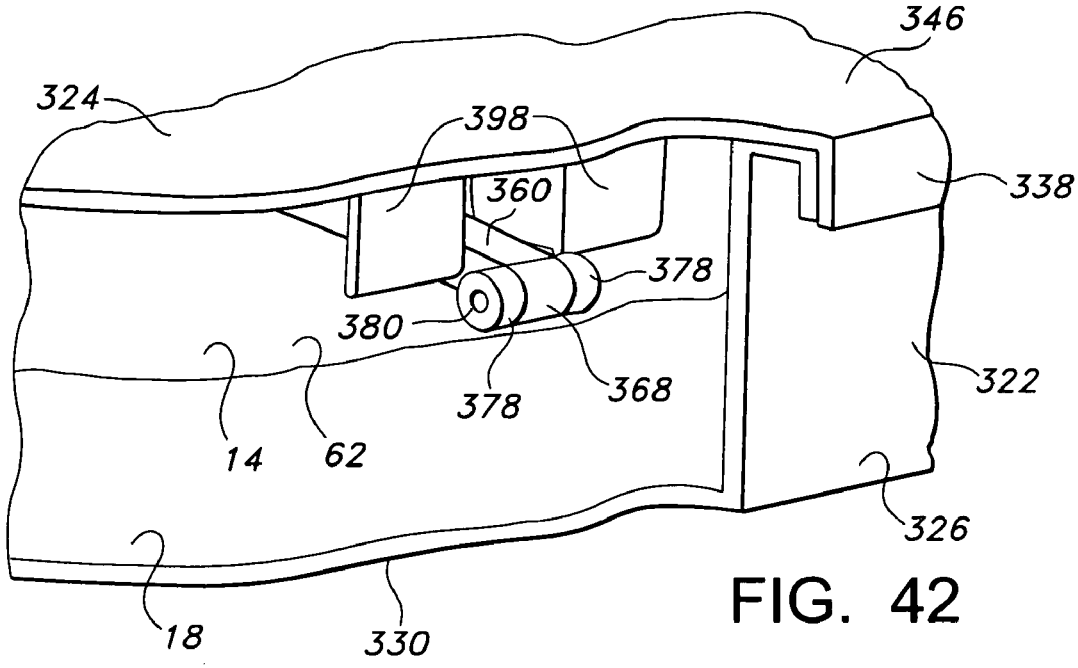
FIG. 42 is a partial perspective view of FIG. 41, showing the position of the toe of the sheet mover and the shield.
Figure 46:
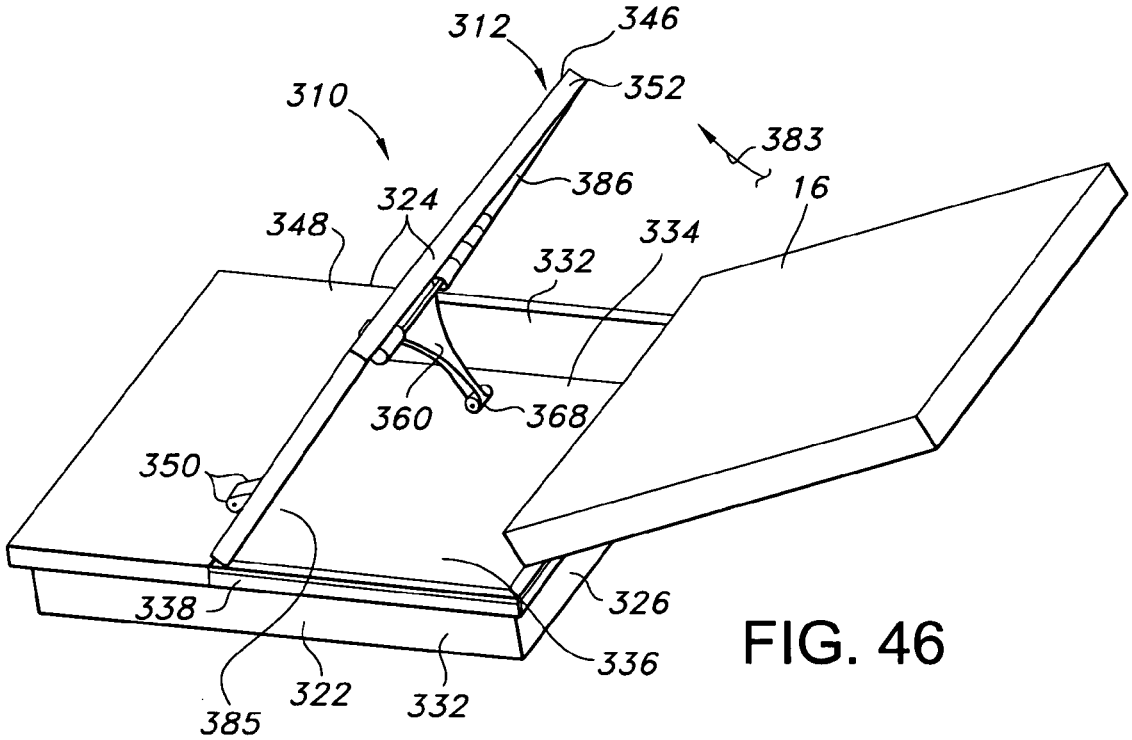
FIG. 46 is a perspective view of the present embodiment, showing a cartridge of sheet materials being loaded into the dispenser while the toe of the pivotal leg is moving freely in the cartridge's path.
Figure 47:
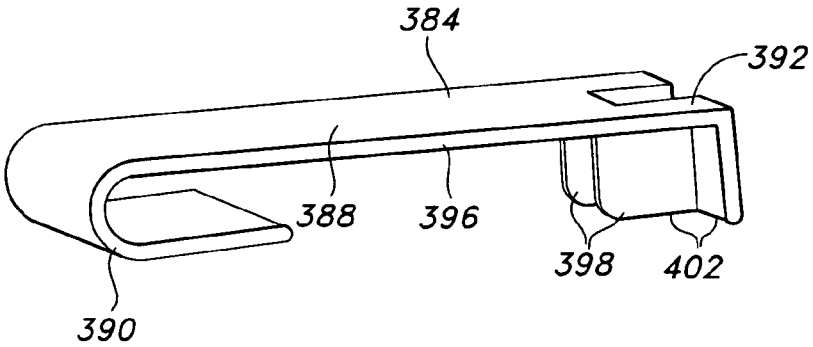
FIG. 47 is a perspective view of a shield provided in the present embodiment.
Figure 48:
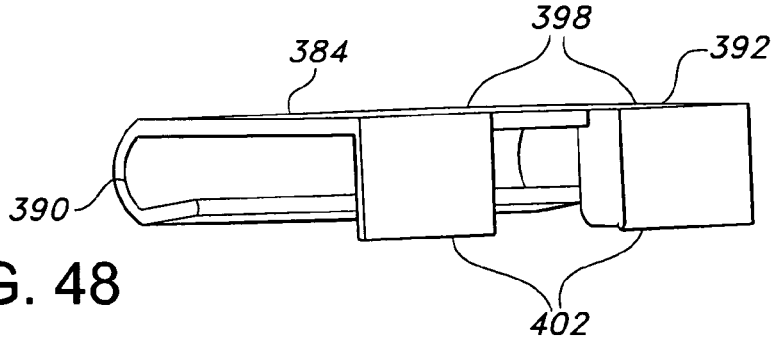
FIG. 48 is a perspective view of the shield of FIG. 47 from another angle.
Figure 49:
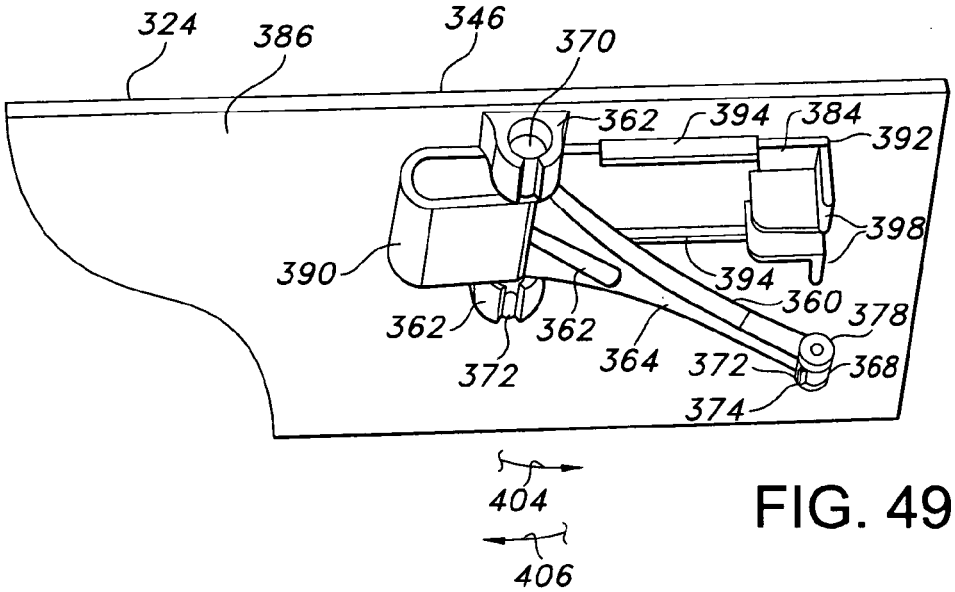
FIG. 49 is a partial perspective view of the lower surface of the lid of the present embodiment, showing the position of the sheet mover with respect to the shield.
Figure 50:
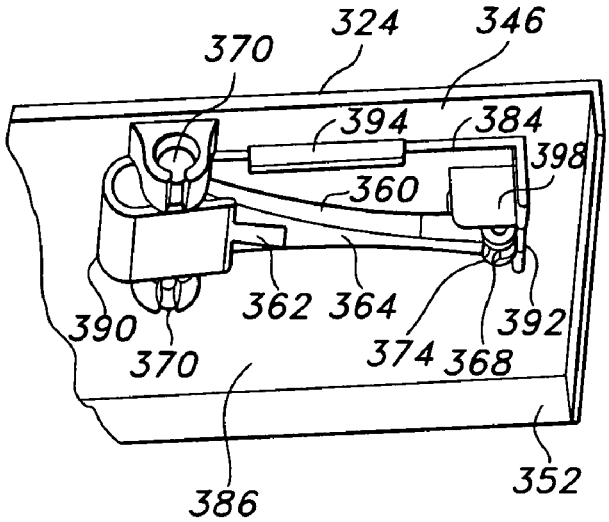
FIG. 50 is a partial perspective view similar to FIG. 49, but showing the sheet mover moving into the shield.
Figure 51:
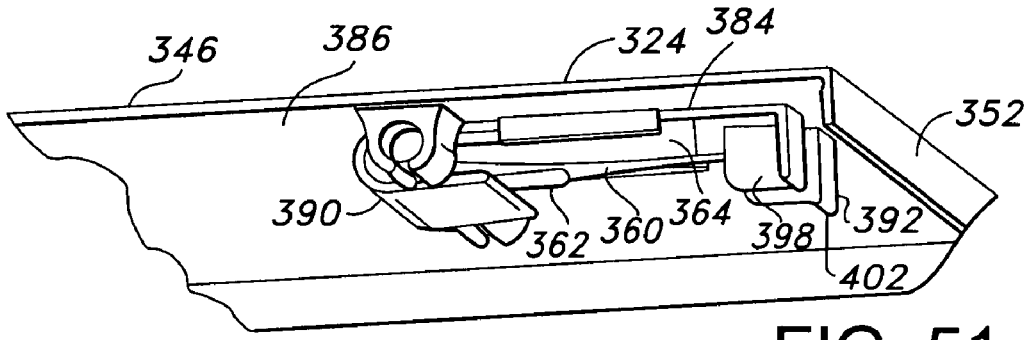
FIG. 51 is a partial perspective view similar to FIGS. 49 and 50, but showing the sheet mover positioned in a non-dispensing position in the shield, edges of a toe retainer extending a distance from the toe retainer to prevent inadvertent contact of a user's hand or of sheet material.
Figure 52:
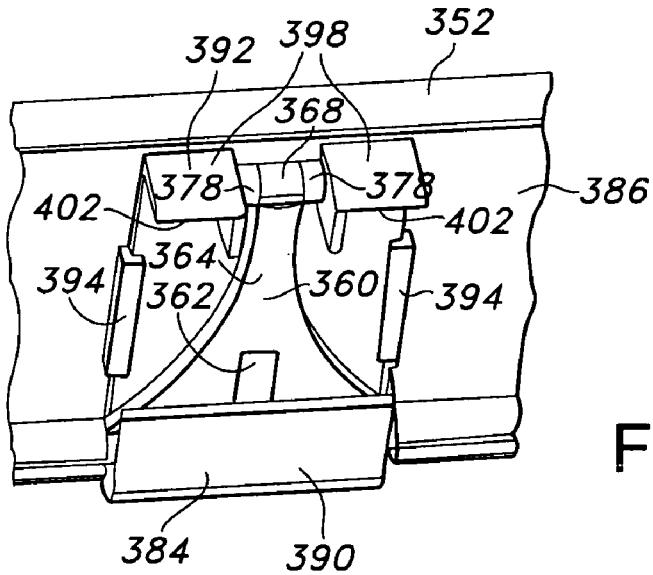
FIG. 52 is a partial perspective view of the shield and sheet mover of FIG. 51, shown from a front perspective.

When the pivotable leg 360 is positioned in a movable, active position to permit the toe 368 and pick 372 thereon to grab or snag and lift a top sheet 62 of the stack 18 of sheet materials 14, the hook 390 of the shield 384 is positioned behind the rounded bar 366 of the leg 360, as shown in FIG. 49. In this position, the toe 368 extends a distance in front of the flanges 398 of the toe retainer 392, as illustrated in FIGS. 42, 43 and 46, and it is free to move against the top sheet 62.

In contrast, when the leg 360 is releasably positioned in a non-moving, resting position by the shield 384, the hook 390 of the shield 384 is moved forward, in a direction 404 (FIG. 49), to urge the leg 360 to move adjacent the lower surface 386 of the first lid section 364. The hook 390 moves over the rounded bar 366 and a portion of the elongated section and against the ramp 382. This action also pulls the toe 368 into a position between the flanges 398 of the toe retainer 392, where the wheels 378 may provide a frictional releaseable coupling between the toe 368 and the flanges 398. To release the leg 360, the hook 390 of the shield 384 is moved in a direction 406 (FIG. 49) away from the rounded bar 366 of the leg 360. This permits the leg 360 to be released such that the toe 368 is moved a distance away from the flanges 398 of the toe retainer 392, so that the toe 368 and pick 372 may operate to lift sheets of material 14 for dispensing.

The resting or non-movable position permitted by the shield 384, as shown in FIGS. 50-53, facilitates loading of a sheet materials 14, such as a stack 18 of sheet materials 14 and/or a cartridge 16 in the dispenser housing 320. In this position, the pick 372 and the toe 368 are held in a position to shield the pick 372 so that sheet materials 14 are easily loaded without the sheet materials 14 or a hand of the user being inadvertently snagged or grabbed by the pick 372.

Figure 53:
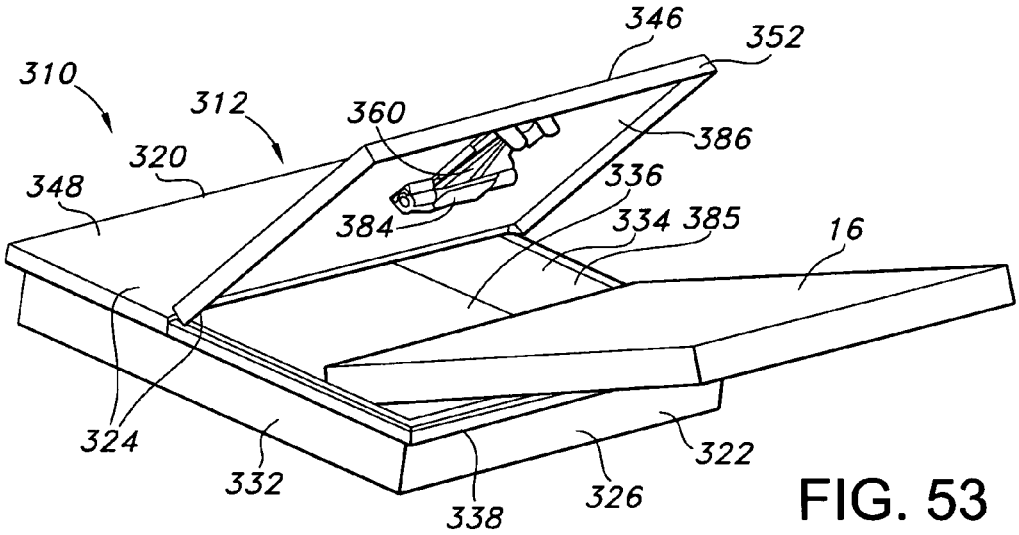
FIG. 53 is a perspective view of the dispenser of the present embodiment showing the sheet mover positioned in the shield to aid in loading a cartridge of sheet materials into the dispenser without snagging the cartridge, sheet materials and/or a user's hand.

In still yet another embodiment of the invention, as shown in FIGS. 54-69, the system 510 and dispenser 512 are similar to the system 10, 110, 310 and dispenser 10, 110, 312 illustrated in FIGS. 1-53 and described in detail herein. The system 510 includes a dispenser 512 which comprises a dispenser housing 520 having a tray container 522 and lid 524, illustrated in FIGS. 54 and 55, which are very similar to the tray container 322 and lid 324. The tray container 522 includes a front wall 526 and a back wall 528 which are spaced-apart and intersect a lower end 530. A pair of spaced-apart side walls 532 intersect the lower end 530 and cooperate with the front and back walls 526, 528 to provide an inner surface 534 and provides an internal compartment 536 configured to hold sheet materials 14, desirably a stack 18 of sheet materials 14 or a cartridge 16 of sheet materials 14 therein. The front wall 526, back wall 528 and side walls 532 may include an L-shaped flange 538 which is positioned on at least an outer surface 540 of the tray container 522. The L-shaped flange 538 desirably includes a rounded rib (not shown).

The lid 524 may include a first lid section 544 which is desirably, but not by way of limitation, pivotably coupled to a second lid section 546 via a hinge to permit the internal compartment 536 and the sheet materials 14 therein to be accessed by a user. The lid 524 may also include a lip 548 which is formed adjacent a perimeter edge 550 of the lid 524. The lip 548 desirably includes a groove (not shown) formed on an inner surface 554 thereof (FIG. 55), which is configured to receive the rib (not shown) therein to provide a releasable closure between the tray container 522 and the lid 524 and to reduce or prevent moisture contained in the dispenser housing 520 from evaporating, as show best in FIGS. 34 and 35 and described previously herein.

Figure 54:
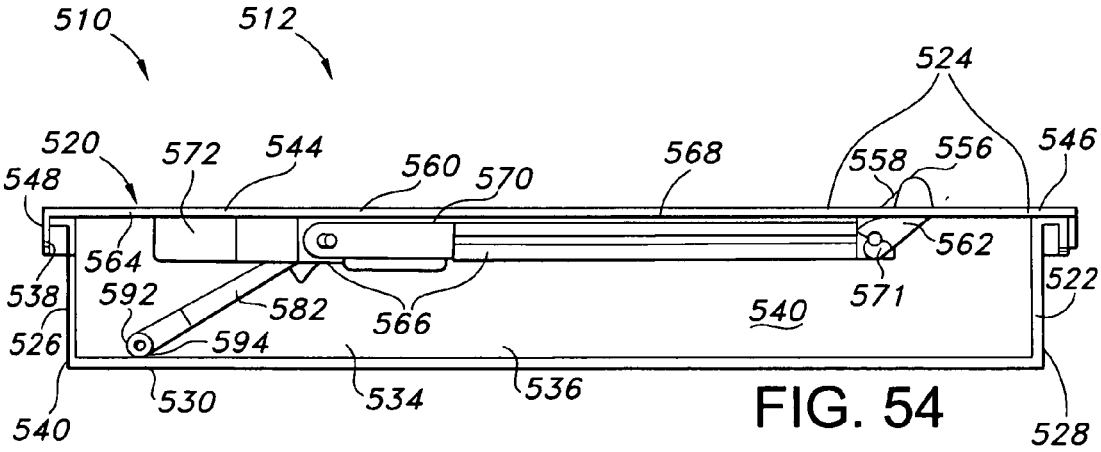
FIG. 54 is a sectional side view of still yet another embodiment of the present invention, the dispenser positioned in a closed, non-dispensing position and the housing including a lid and a tray container.
Figure 55:
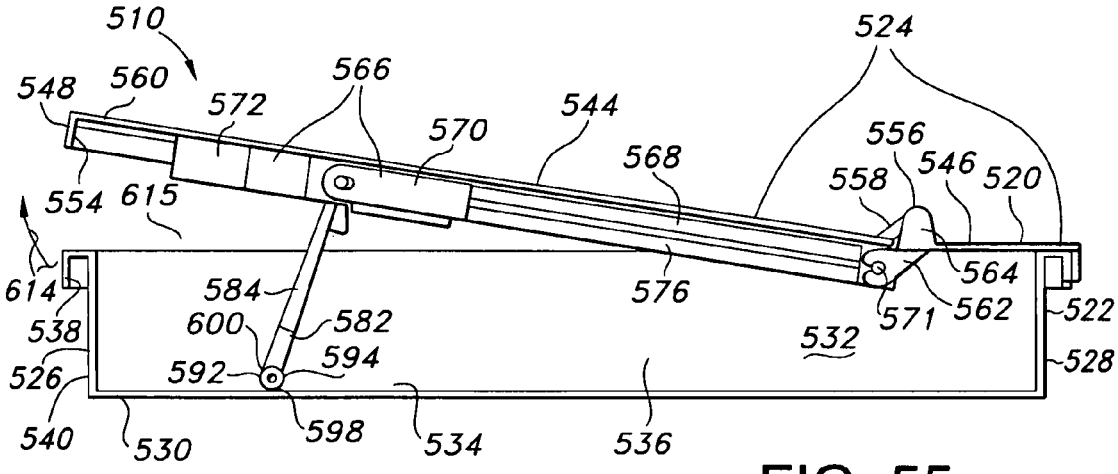
FIG. 55 is a sectional side view of the dispenser of FIG. 54, but showing the dispenser positioned in a partially opened position.
Figure 56:
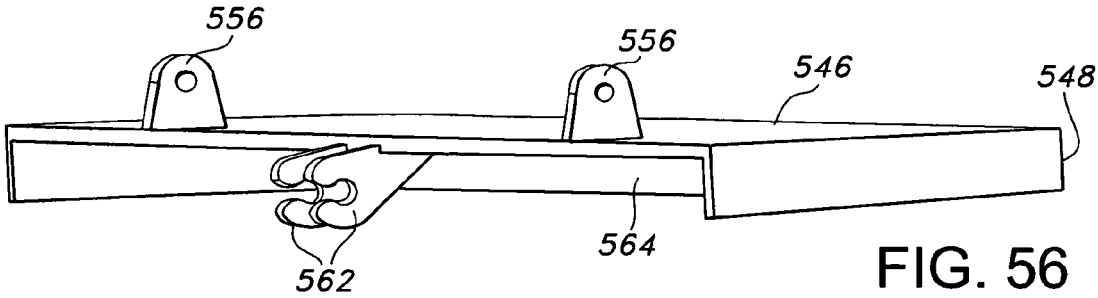
FIG. 56 is a perspective view of a second lid portion of the dispenser of FIGS. 54 and 55.

The second lid section 546, as illustrated in FIGS. 54-56, desirably includes at least one hinge 556. In this instance, a pair of hinges 556 is provided, each having an arm 558 (best shown in FIG. 60) which, at one end, is coupled to an upper surface 560 of the first lid section 544 and at an opposite end is pivotably coupled to the hinge 556.

Figure 57:
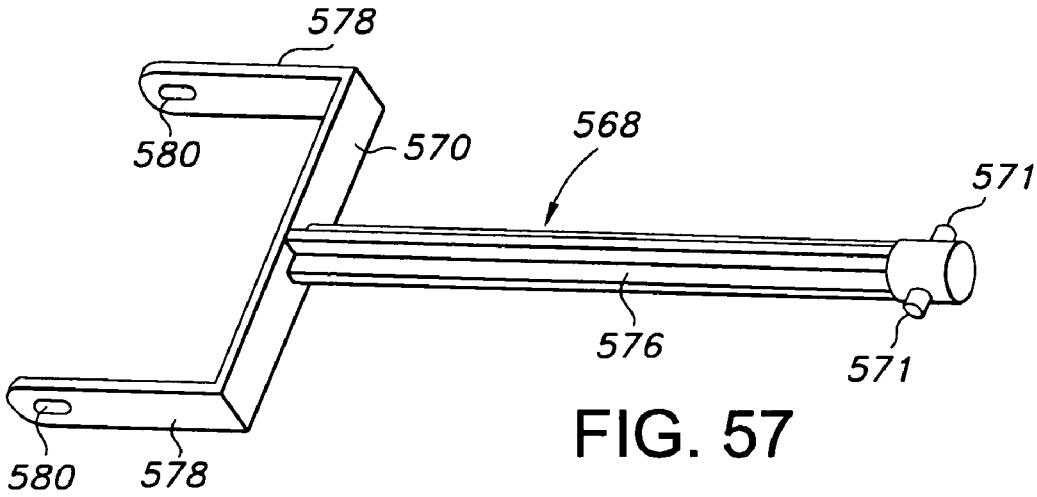
FIG. 57 is a perspective view of a push rod of the dispenser of FIGS. 54 and 55.
Figure 58:
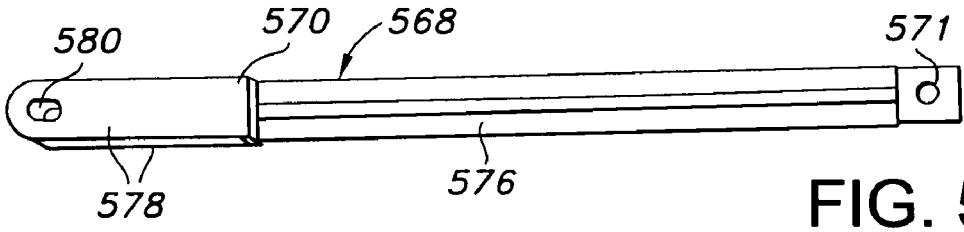
FIG. 58 is a side view of the push rod of FIG. 57.
Figure 59:
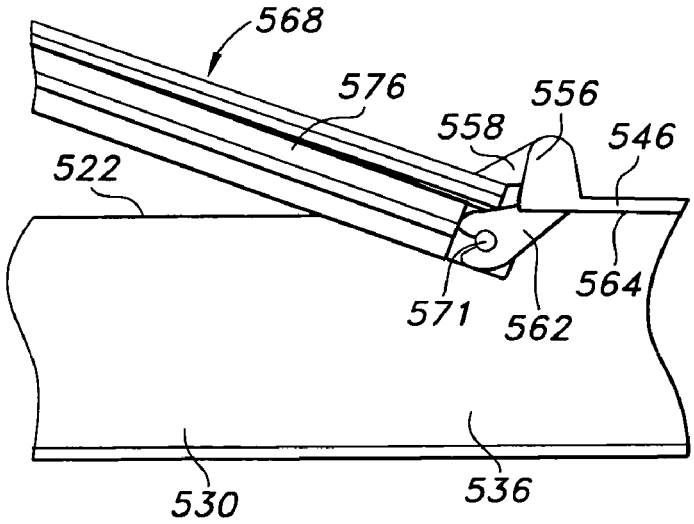
FIG. 59 is a partial sectional view of FIG. 56, but showing the an end of the push rod coupled to arms provided by the second lid section.

The second lid section 546 also includes a pair of arms 562 which are coupled at one end to a portion of a lower surface 564 of the second lid section 546 and at an opposite end to a portion of a locking assembly 566. The locking assembly 566, as shown in FIGS. 54,55, 57-61 and 63-69, includes a push rod 568 having a U-shaped yoke 570 at one end and a pair of pins 571 at the other, as well as a shield 572 coupled to a lower surface 564 of the first lid section 544. The arms 562 coupled at one end to a portion of a lower surface 564 of the second lid section 546 provide an opening (FIG. 56) therein to pivotably couple the arms to the pair of pins 571 (FIG. 59). The push rod 562 includes a rod portion 576 including pins 571 at one end and the U-shaped yoke 570 at the opposite end, as illustrated in FIGS. 57-59. The yoke 570 desirably has a pair of spaced-apart arms 578. A slot 580 is formed at the end of each arm 578. The yoke 570, in operation, is configured to be positioned over at least a portion of the shield 572. The shield 572 is formed with or coupled to the lower surface 564 of the first lid section 544 (FIGS. 53 and 54).

Figure 60:
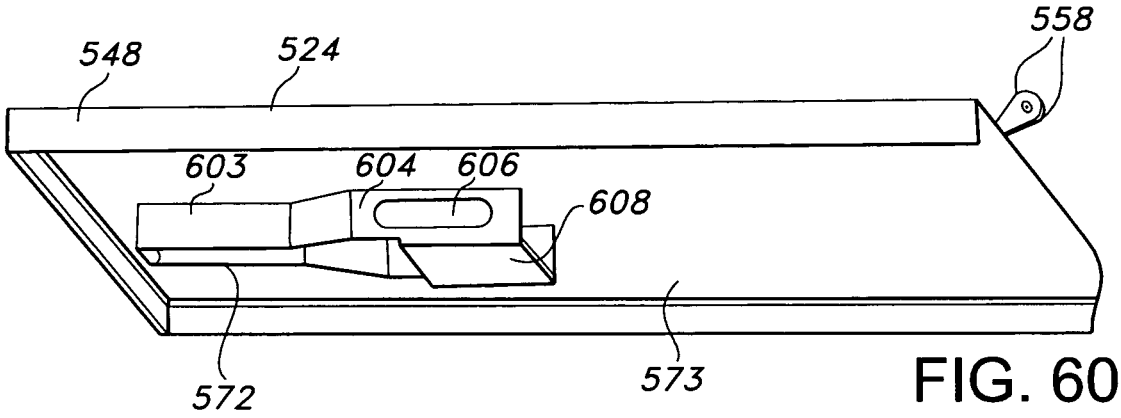
FIG. 60 is a partial perspective view of the first lid section of the present embodiment, showing a shield positioned on a lower surface.
Figure 61:
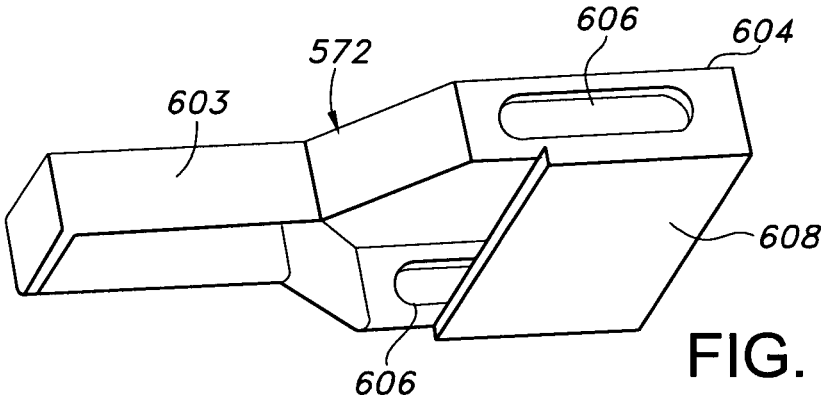
FIG. 61 is a perspective view of the shield of FIG. 60.
Figure 62:
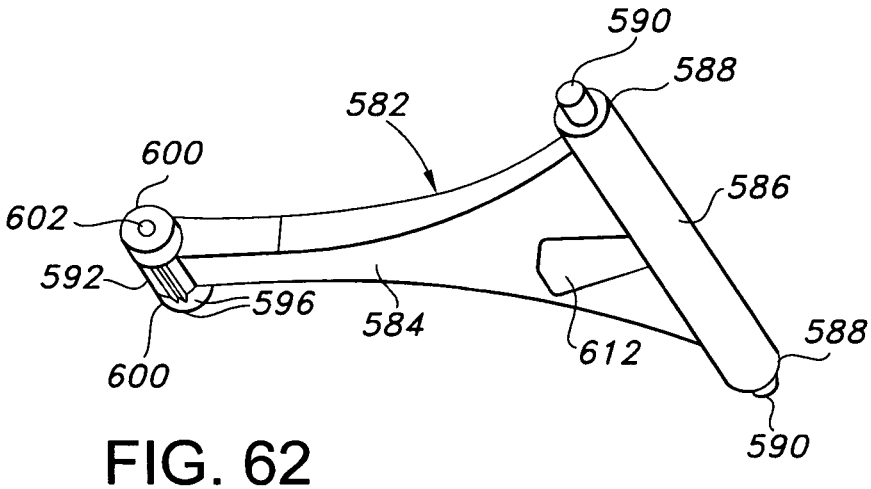
FIG. 62 is a perspective view of the sheet mover of FIGS. 54 and 55.
Figure 69:
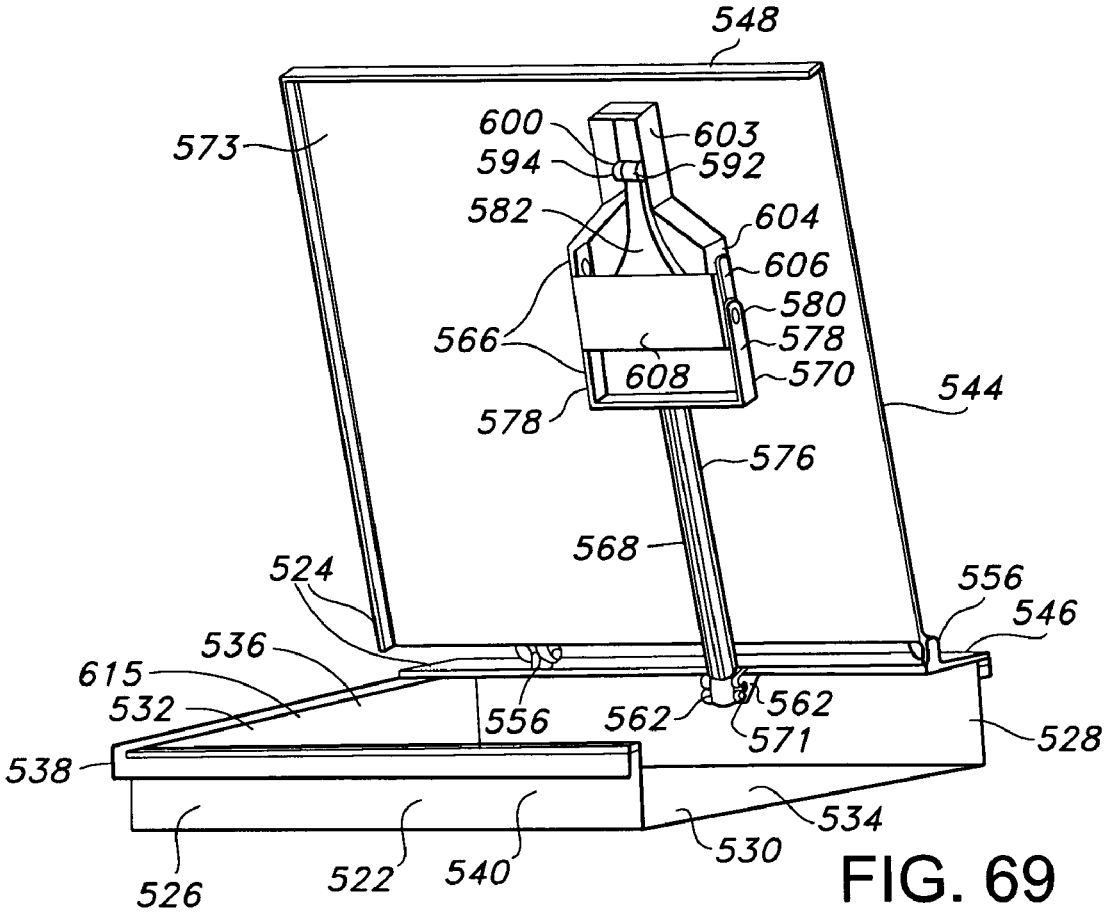
FIG. 69 is a partial front perspective view of the dispenser of FIG. 68, showing the sheet mover positioned completely within the shield.

A pivotal leg 582 is configured to be received into and held in the shield 572 of the locking assembly 566, as shown in FIGS. 68 and 69. The generally T-shaped pivotal leg 582, as shown in, for example, FIG. 62, includes an elongated portion 584 having at one end a roller bar 586 positioned transversely relative to the elongated portion 584. The roller bar 586 has spaced-apart rounded ends 588, each having a drag pin 590 extending therefrom and in axial alignment therewith. The opposite end of the elongated portion 584 includes a toe 592. The toe 592 comprises a pick 594 having one or more teeth 596 which are desirably, but not by way of limitation, positioned on a lower surface 598 of the toe 592. The toe 592 also includes a pair of wheels 600 which are rotatably mounted via a pin 602 on either side of the toe 592 that rotatably couple the wheels 600 thereto. The wheels 600 desirably move tangent to the top sheet 62 of the stack 18 of sheet materials 14 to permit smooth movement of the toe 592 as it rolls or moves over the top sheet 62 to snag or grab the top sheet 62 at the appropriate location on the top sheet 62 via one or more teeth 596 of the pick 594, and move the top sheet 62 away from the stack 18 to permit a user to easily remove the top sheet 62 from the pick 594 and from the dispenser 512, as illustrated in FIGS. 60 and 61.

Figure 63:
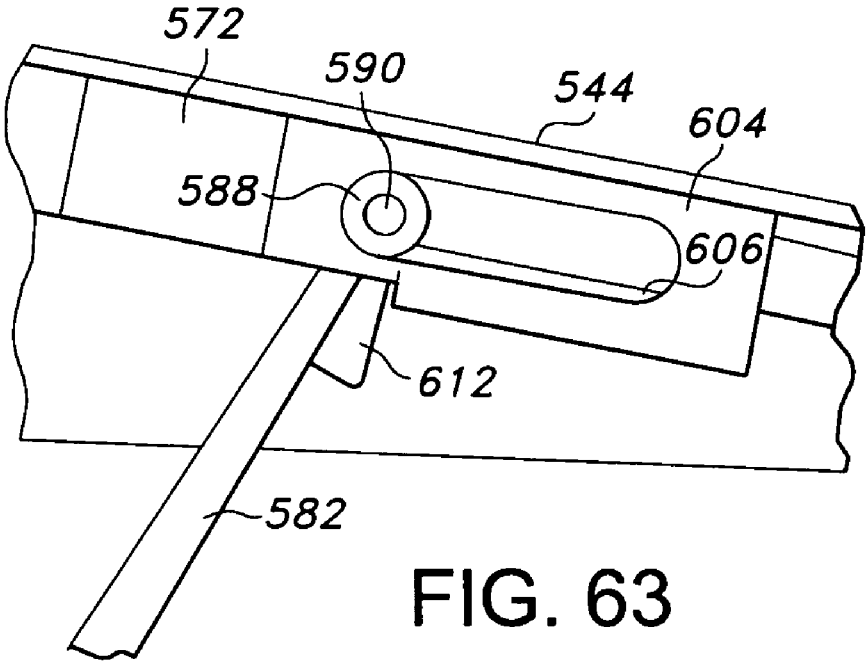
FIG. 63 is a partial side view of the end of the sheet mover as it moves within the slot in the shield.
Figure 64:
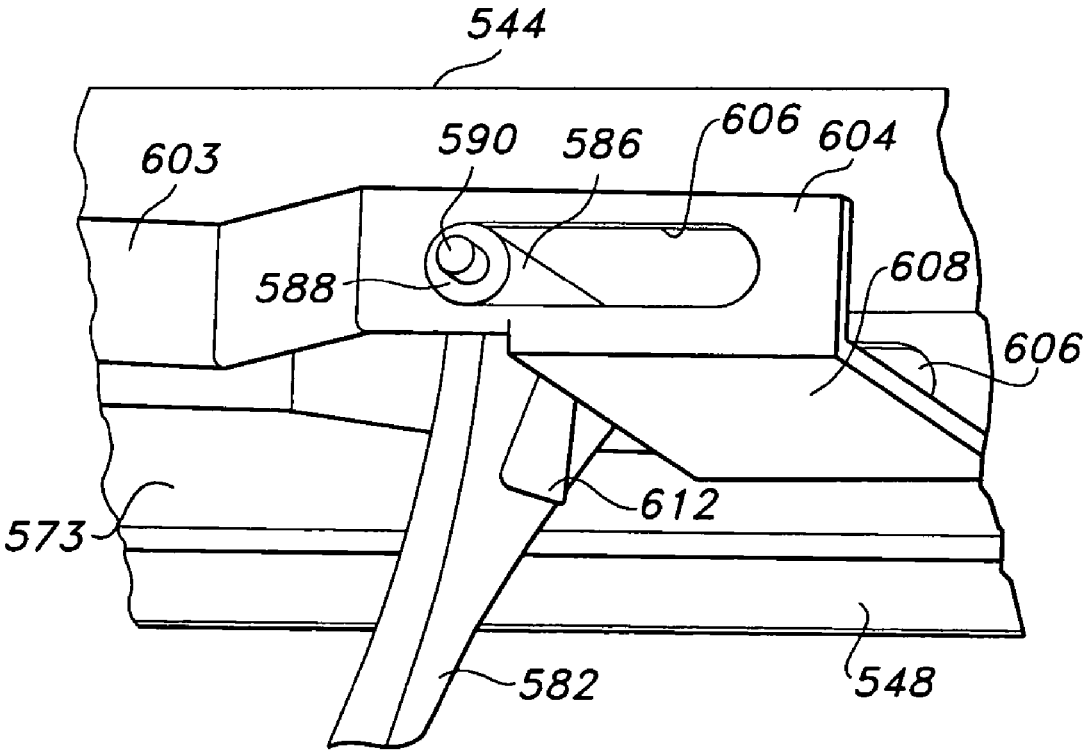
FIG. 64 is a partial perspective view of the sheet mover and its limit of movement relative to its position in the slot of the shield; in addition, the ramp of the sheet mover is shown contacting a portion of the shield, the portion positioned to leverage against the ramp so that the ramp urges the sheet mover to move into the shield.

The shield 572 follows the general shape and configuration of the pivotal leg 582. The shield 572 includes a neck portion 603 which holds the toe 592 and a portion of the elongated portion 584 of the leg 582. The shield 572 also includes a body portion 604 which is configured to hold the roller bar 586 and the remaining portion of the elongated portion 584 of the leg 582. Slots 606 are provided on opposite sides of the body portion 604, and a retaining bar 608 is positioned across the body portion 604. The pivotal leg 582 is positioned in the shield 572 such that each end 588 of the roller bar 586 extends through a slot 606 to permit pivotable movement as well as forward and backward movement of the leg 582 within the shield 572, as shown in FIGS. 63 and 64. The pivotal leg 582 includes a ramp 612 positioned on a portion of the elongated portion 584 and adjacent the roller bar 586 which acts as a lever to move the leg 582 upward as the leg 582 is moved rearward within the shield 572.

Figure 65:
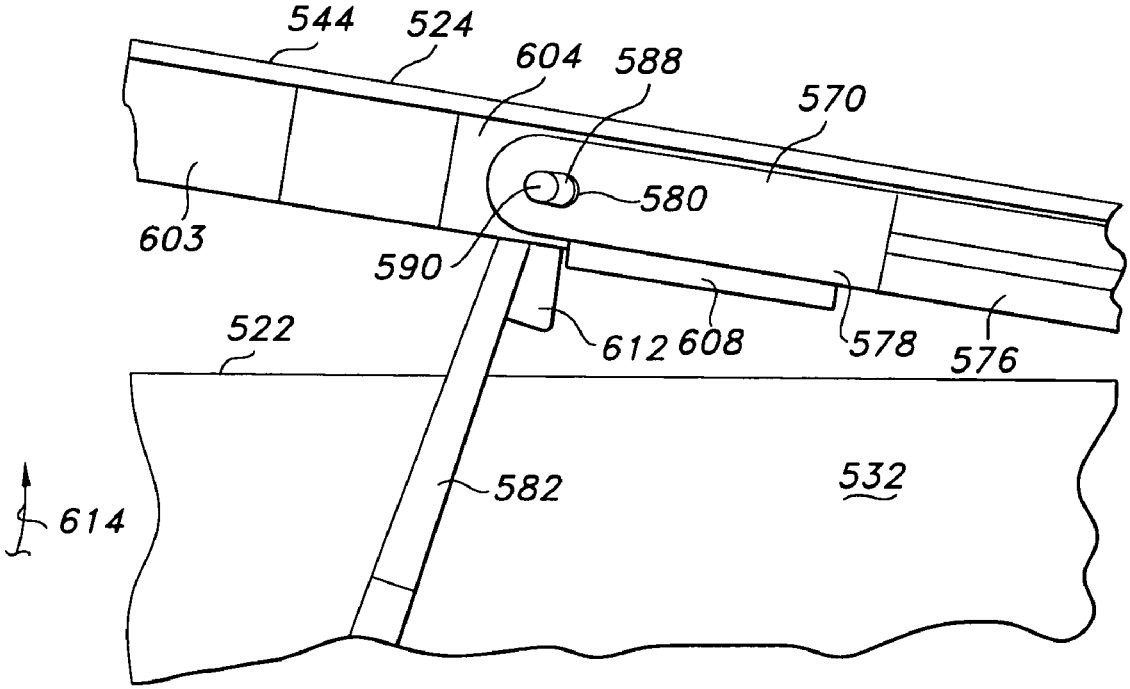
FIG. 65 is a partial side view of a yoke of the push rod positioned over the shield and the position of the drag pins of the sheet mover in slot of each arm of the yoke.
Figure 66:
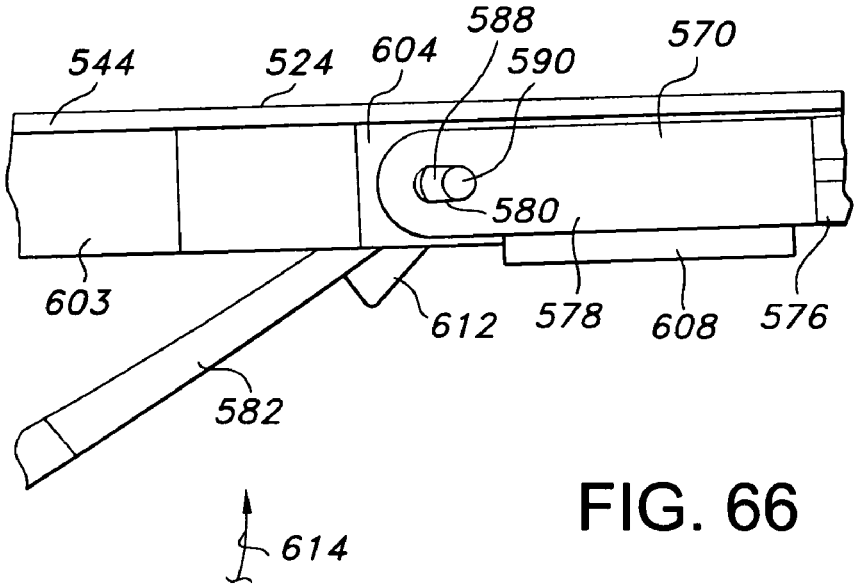
FIG. 66 is a partial side view similar to FIG. 65, showing the change of position of the drag pins of the sheet mover in the slots of the yoke of the push rod when the lid is in a closed, non-dispensing position.

Each arm 578 of the yoke 570 couples to one of the drag pins 590 via a slot 580, as shown in FIGS. 65-69. The slots 606 in the shield 572 permit the leg 582 to move as described below to pick up or move at least a portion of the top sheet 62. As the first lid section 544 is raised in an opening direction 614, the slots 580 in the yoke 570 first move over pins 590 which provides a dwell period prior to the pivotal leg 582 being pulled rearward. This design ensures that the pivotal leg 582 can pivot or move through the range of movement needed to snag, grab or push the lowest or last sheet material 14 in the stack 18 of sheet materials 14, i.e. the last top sheet 62, before the leg 582 starts getting pulled upward into the locking assembly 566. FIG. 66 illustrates the first lid section 544 closed and the drag pins 590 positioned rearward in the slot 580 in the arms 578 of the yoke 570. As first lid section 544 is opened, the slot 580 moves until its forward end contacts the drag pins 590, as shown in FIG. 65, at which time the pivotal leg 582 is pulled rearward and upward via the ends 588 in the slots 606 of the shield 572. When the drag pins 590 of the pivotal leg 582 contact the front of the slot 580 in the yoke 570, the attached push rod 568 pulls the drag pins 590 and the ends 588 of the leg 582 rearward within the slot 606 of the shield 572. This action also moves the ramp 612 on the elongated portion 584 of the leg 582 against the retaining bar 608 of the shield 572. These two actions cooperate to pull the leg 582 into the shield 582 of the locking assembly 566 when the first lid section 544 is raised higher in the opening direction 614. With the leg 582 completely held by the shield 572, the toe 592 and the pick 594 are positioned therein and are therefore moved away from a user's hand. The neck portion 603 of the shield is configured to extend beyond the toe 592 and the pick 594 thereon. This configuration protects the user's hand from being pricked by the pick 594. In addition, the leg 582 is moved out of the way so that additional sheet materials 14 may be added to the tray container 522 without the sheet material 14 getting snagged or grabbed by the pick 594 during insertion. When in a dispensing position, however, the shield 572 and the slot 610 therein is positioned such that the toe 592 and pick 594 of the pivotal leg 582 will move sufficiently within the internal compartment 536 and against the sheet material 14 therein that the pick 574 will snag or grab the lowest or last sheet in the stack 18 of sheet materials 14.

The dispensing action occurs when the first lid section 544 of the lid 524 is raised in the opening direction 614. The toe 592 is moved across the top sheet 62 in the stack 18 of sheet material 14 until the teeth 596 of the pick 594 contact the top sheet 62. The first lid section 544 continues to be moved upward, and the teeth 596 of the pick 594 snags or grabs a portion 68 of the top sheet 62 and moves the grabbed portion upward and/or away from the remainder of the stack 18, as shown previously herein in FIGS. 7 and 8. As the first lid section 544 continues to be raised in the opening direction 614, the internal compartment 536 and the portion 68 of the top sheet 62 becomes accessible via an exit port 615 provided when the first lid section 544 is opened to be grasped by a user, desirably between a user's finger and thumb, or by an implement, such as, for example, forceps, tongs, and so forth.

Once the portion 68 of the top sheet 62 is grasped and removed from the pick 594, the pivotable leg 582 continues to move upward as the first lid section 544 is opened. This action moves the leg 582 into the shield 572, as shown in FIGS. 68 and 69, thereby moving the teeth 576 of the pick 594 away from the user or new sheet material 14 being inserted into the internal compartment 536 of the tray container 522. When the user's hand is removed, or the sheet material 14 is completely positioned in the tray container 522, the first lid section 544 is moved in a closing direction 618 (FIGS. 67 and 68). This action permits the toe 592 of the pivotal leg 582 to move downward, out of the shield 572 and into its resting position against the new top sheet 62 of the stack 18 of sheet material 14. The toe 592 and pick 594 thereon are again in a position to move over the top sheet to snag or grasp another portion 616 of the new top sheet 62 for removal. The first lid section 544 desirably closes sufficiently such that evaporation of any moisture contained in the dispenser housing 520 is reduced or eliminated (FIG. 54).

For all systems 10, 110, 310 and 510, it will be understood that the pick is not required to push the sheet material away from a stack of sheet materials, or away from adjacent sheet materials. Rather, a pusher, that is, the end of the toe which is configured to cause friction against the top sheet may be used instead to move the top sheet away from the stack of sheet materials or adjacent sheet materials. The term "sheet mover" as used herein is intended to encompass both the "pick" and the "pusher" as well.

The system 10, 110, 310, 510 may be positioned adjacent and secured to a support surface (not shown) via a mounting bracket. Such a mounting bracket is disclosed in U.S. Pat. No. 6,533,145 to Richard P. Lewis, et al., which is hereby incorporated by reference herein for all purposes. Other mounting apparatus may be used as well. For example, the dispenser may have an adhesive thereon for holding it in place. Alternatively, the adhesive is a cohesive adhesive wherein both a portion of the dispenser and the support surface have some cohesive adhesive thereon. Mechanical fasteners, suction cups, hook and loop materials, and so forth may be used, and are provided herein as non-limiting examples. It will be understood that any apparatus known to those skilled in the art may be used.

The dispenser 12, 112, 312, 512 of the embodiments shown herein each include a housing 20, 120, 320, 520 including a container 22, 122, 322, 522 and a lid 24, 124, 324, 524, which cooperate to provide an inner surface 34, 134, 334, 534 formed to include an internal compartment 36, 136, 336, 536 configured to hold sheet material 14. The housing 20, 120, 320, 520 includes an exit port 72, 231, 385, 615 for the withdrawal of sheet material 14 therefrom. The dispenser 12, 112, 312, 512 also includes a sheet mover 48, 184, 360, 582 mounted to the housing 20, 120, 320, 520. A portion of the sheet mover 48, 184, 360, 582 is configured to move over at least a portion of sheet material 14, desirably the top sheet 62, positioned in the housing 20, 120, 320, 520 such that at least the portion 68 is moved away from additional sheet materials 14 positioned adjacent thereto by the sheet mover 48, 184, 360, 582. The portion 62 moved away is positioned to be easily withdrawn through the exit port 72, 231, 385, 615 by a user.

The system 10, 110, 310, 510 for dispensing sheet material 14 of the embodiments shown herein include a dispenser 12, 112, 312, 512 which includes a housing 20, 120, 320, 520. The housing 20, 120, 320, 520 includes a container 22, 122, 322, 522 and a lid 24, 124, 324, 524, which cooperate to provide an inner surface 34, 134, 334, 534 formed to include an internal compartment 36, 136, 336, 536 configured to hold sheet material 14. The housing 20, 120, 320, 520 includes an exit port 72, 231, 385, 615 for the withdrawal of sheet material 14 therefrom. The dispenser 12, 112, 312, 512 also includes a sheet mover 48, 184, 360, 582 mounted to the housing 20, 120, 320, 520. A portion of the sheet mover 48, 184, 360, 582 is configured to move over at least a portion of sheet material 14, desirably the top sheet 62. A plurality of sheet material 14, desirably a stack 18 of general aligned sheet materials 14, are disposed in the internal compartment 36, 136, 336, 536 of the housing 20, 120, 320, 520 such that at least one sheet material 14, desirably the top sheet 62 is positioned adjacent the sheet mover 48, 184, 360, 582. When the sheet mover 48, 184, 360, 582 moves over a portion of the sheet material 14, at least the portion 68 is moved away from the plurality of sheet material 14 by the sheet mover 48, 184, 360, 582 such that the portion 68 is positioned to be easily withdrawn through the exit port 72, 231, 385, 615 by a user. It will be appreciated that the system may be constructed to be a one-use, disposable system so that when all sheet materials are removed from the dispenser, the dispenser is thrown away or disposed of. In clean room-type situations, this may be desirable, to cut down on contamination by lint, dust, and so forth.

The sheet material 14 used as a part of the system 10, 110, 310, 510 is desirably, but not by way of limitation, contained in a stack 18 of sheet materials 14. In some instances, the sheet material 14 may be contained in a cartridge 16, as shown, for example, in FIGS. 70-72. Such a cartridge 16 may include a stack 18 of aligned sheet materials 14 which are connected by a band, or by a connection, such as, but not by way of limitation, an adhesive connection, a tab connection, and so forth, at one or more areas of the stack 18. The cartridge 16 may be provided as a polymer or plastic package, having a seal or lid portion 17 of the polymer or plastic which is removable. In this manner, when the cartridge is positioned in the tray container, a portion of the polymer or plastic is removed so that the leg and sheet mover may access the sheet material 14.

Figure 71:
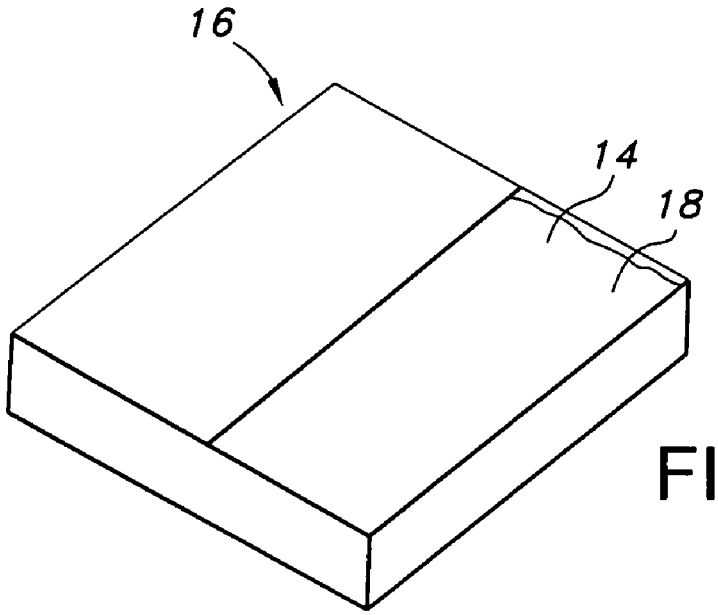
FIG. 71 is a perspective view of the cartridge of FIG. 70, showing the lid removed.
Figure 72:
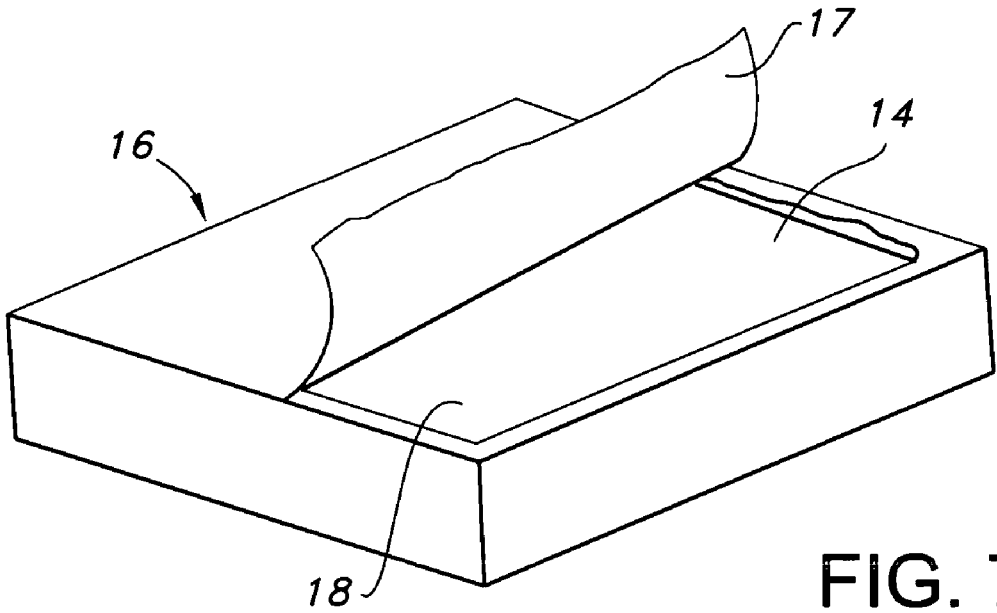
FIG. 72 is a perspective view of another cartridge having a removable lid covering substantially the upper surface of the cartridge, one end of the removable lid lifted for illustrative purposes.

The cartridge 16 may include a tub in which at least a portion of a top portion of the tub includes a removable material or lid portion 17. Alternatively, the cartridge may include a plastic container having a lid or removable portion on at least a portion of a surface thereof. In another alternative, the cartridge may include a polymer, foil, or a combination thereof in a package. At least a portion of the package is desirably removable, to permit access to the sheet material therein, as shown in FIG. 71. Alternatively, the sheet material may be provided as a stack of single sheet materials which are generally aligned but unconnected and not contained in a cartridge.

The sheet material (premoistened or dry) may include one or more materials, such as, but not by way of limitation, meltblown fibers, spunbond fibers, polyester, spunlace, cellulose, and so forth. The sheet material may be provided as dry sheet material, and may be dispensed as dry sheet material. A liquid solution may be added to the sheet material, either before or after it is inserted into a dispenser. Such liquid solution may include, alone or in combination, but not by way of limitation, isopropyl alcohol, deionized water, and so forth.

The sheet materials 14, stack 18 of sheet materials 14 and/or cartridge 16 may be provided in any shape, or combination of shapes and configurations. The sheet material may be provided as symmetrical sheet material, or asymmetrical sheet material. Similarly, the dispenser housing may be provided in any configuration, so long as such configuration permits sheet material to be inserted therein to be dispensed therefrom.

The dispenser may be provided pre-filled, with a stack of sheet material positioned therein. In this manner, the dispenser may be configured as a single use, non-refillable, disposable dispenser. The sheet material in the dispenser may be provided as dry sheets or premoistened sheets. Such a dispenser may be desirable in a clean room environment for semiconductors, where the need for minimal dust contamination is more important than a re-useable dispenser.

The cartridge 18 may comprise one or more of the features or characteristics of the dispenser. For instance, the cartridge may include a housing having a portion which is pivotably movable and a pivotal leg/sheet mover coupled thereto. The cartridge may be positioned in a separate, outer housing for dispensing.

Any spring or spring member shown and or described herein may be made from a material or a combination of materials. Such materials include, but are not limited to, metal, plastic, and so forth. Similarly, the pick or pusher shown and/or described herein may be constructed from any suitable material that operates as described herein, such as rubber, metal, plastic, bristles (natural or synthetic), and so forth.

The dispenser 12, 112, 312, 512 may be constructed from any suitable material or combination of materials. Such materials include, but are not limited to, plastic, metal, paper, fiber, wood, and so forth; combinations of these materials may be used together as well. The system 10, 110, 310 or 510 and/or the dispenser 12, 112, 312, 512 may be configured to be a non-refillable, single use, disposable dispenser. In this instance, the dispenser 12, 112, 312, 512 may be constructed from suitable materials for disposal, including, but not limited to, paper, paperboard, plastic, fiber, metal, and so forth. Similarly, combinations of these materials may be utilized. The configuration of the dispenser 12, 120, 312, 512 and the dispenser housing 20, 120, 320, 520 shown and/or described herein are provided as non-limiting examples. Similarly, the configuration(s) of sheet material 14 and/or cartridge(s) 16 shown and/or described herein are provided as non-limiting examples. Any configuration of dispenser, dispenser housing, including any element of the dispenser housing, and/or sheet material may be used, so long as it operates as generally described herein. It will be appreciated that any feature(s) in any embodiment shown and/or described herein may be used, substituted and/or combined with any other feature(s) in any other embodiment.

While certain characteristics are described in specific embodiments, any one or more characteristics, features, and/or elements may be used in any combination in any embodiment, or to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for dispensing sheet material, the dispenser comprising:

a housing including a container and a lid which cooperate to provide an inner surface formed to include an internal compartment configured to hold sheet material, the housing including an exit port for withdrawal of sheet material therefrom; and a sheet mover mounted to the housing and configured to move sheet material positioned in the housing, such that when the lid is lifted, a portion of the sheet mover contacts at least a portion of a sheet material positioned in the housing and moves in one direction across and against the portion of the sheet material such that the portion of the sheet material is at least briefly coupled to the portion of the sheet mover and is moved in the one direction, then the sheet mover reverses direction and moves in an opposite direction and towards the lid as the lid is lifted, wherein the portion of the sheet material is moved at least in the one direction, and wherein the portion of the sheet material moved is positioned to be easily withdrawn through the exit port by a user.

2. The dispenser of claim 1, wherein the sheet mover includes a leg which includes a toe, and wherein the toe is configured to contact and move over a surface of the portion of the sheet material and briefly couple to the portion to move at least the portion.

3. The dispenser of claim 2, wherein at least the lid includes a front side from which the lid is lifted and a back side positioned opposite the front side, and wherein when the lid is being lifted, the toe of the sheet mover moves across and against the sheet material towards the back side of the lid and the pick snags the portion of the sheet material and moves the portion of the sheet material towards the back side, and then the toe of the sheet material reverses direction and moves toward the front side of the lid and upward toward the lid as the lid is elevated upward and away from the front side of the container.

4. The dispenser of claim 2, wherein the dispenser further comprises an assembly for moving the leg, and wherein the assembly includes a push rod having a yoke and a shield.

5. The dispenser of claim 4, wherein the shield is positioned against the lid and includes slots, and wherein one end of the leg is pivotally coupled to the lid, the end of the leg including a rounded bar having a pair of spaced-apart ends, the slots configured to permit the ends to rotate and slidably move therein.

6. The dispenser of claim 5, wherein the yoke includes slots which are configured to hold drag pins which extend from each of the ends, and wherein the yoke is positioned over at least a portion of the shield, and wherein the push rod is movably coupled to a portion of the lid.

7. The dispenser of claim 6, wherein the shield, the push rod and the yoke cooperate with the leg to releasably move the leg into the shield and retain the leg within the shield when at least a portion of the lid is positioned in an open loading position.

8. The dispenser of claim 7, wherein when the leg is moved against the lid, the leg releasably locked in a position by the assembly.

9. A dispenser for dispensing sheet material, the dispenser comprising:

a housing including a container and a lid which cooperate to provide an inner surface formed to include an internal compartment configured to hold sheet material, the housing including an exit port for withdrawal of sheet material therefrom; and a sheet mover mounted to the housing, the sheet mover including a leg having one end which is pivotally coupled to the lid of the housing, the leg having a toe positioned on an opposite end which includes a pick, the toe configured to contact and move across and against at least a surface of a portion of a sheet material positioned in the housing, the pick configured to snag the portion of the sheet material to move it, such that at least the portion of the sheet material is at least briefly coupled to the sheet mover via the toe and pick and moved away from at least a portion of any additional sheet materials positioned adjacent thereto by the sheet mover, wherein the portion of the sheet material moved is positioned to be easily withdrawn through the exit port by a user, and wherein the lid includes a locking assembly to releasably lock the pivotal leg in a non-movable position.

10. The dispenser of claim 9, wherein the locking assembly includes a push rod having a yoke and a shield.

11. The dispenser of claim 10, wherein the shield is positioned against the lid and includes slots, and wherein the end of the leg pivotally coupled to the lid includes a rounded bar having a pair of spaced-apart ends, the slots configured to permit each end of the rounded bar of the pivotal leg to rotate and slidably move therein, and wherein the push rod is movably coupled to a portion of the lid.

12. The dispenser of claim 11 wherein the yoke includes slots which are configured to hold drag pins which extend from each end of the rounded bar of the pivotal leg, and wherein the yoke is positioned over at least a portion of the shield.

13. The dispenser of claim 9, wherein the locking assembly is configured to move the leg, such that when the lid is lifted, the toe of the leg is first moved in one direction across the sheet material to snag the portion of the sheet material on the pick and then the toe of the leg reverses direction and moves in an opposite direction and then upward, towards the lid.

14. The dispenser of claim 13, wherein the shield, the push rod and the yoke cooperate with the pivotal leg to releasably move the leg into the shield and retain the leg within the shield when at least a portion of the lid is positioned in an open loading position.

15. A dispenser for dispensing sheet material, the dispenser comprising:

a housing comprising a container and a lid which cooperate to provide an inner surface formed to include an internal compartment configured to hold sheet material, the housing including an exit port for withdrawal of sheet material therefrom; and a sheet mover mounted to at least a portion of the housing and configured to move in more than one direction when activated to move sheet material adjacent to the exit port, such that when the sheet mover is activated, a portion of the sheet mover contacts at least a portion of a sheet material positioned in the housing and moves in one direction across and against the portion of the sheet material to move the portion of the sheet material at least briefly in the one direction, then the sheet mover moves in an other direction and moves the portion of the sheet of material at least briefly in the other direction, and then the sheet mover moves toward the lid as the lid continues to be lifted, wherein the portion of the sheet material moved is positioned to be easily withdrawn through the exit port by a user.

16. The dispenser of claim 15, wherein the sheet mover is activated by lifting the lid, and wherein at least the lid includes a back side positioned opposite the front side, and wherein the sheet mover moves toward the back side, changes direction and moves toward the front side, then moves next to the lid as the lid continues to be lifted.

17. The dispenser of claim 16, wherein the sheet mover includes a leg which includes a toe, and wherein the toe is configured to contact and move over a surface of the portion of the sheet material and briefly couple to the portion to move at least the portion.

18. The dispenser of claim 17, wherein the toe includes a pick, and wherein when the lid is being lifted, the toe of the sheet mover moves across and against the sheet material and the pick snags the portion of the sheet material and moves the portion of the sheet material in the one direction, and then the toe moves in the other direction and moves the sheet material at least briefly in the other direction as the lid is elevated upward.

19. The dispenser of claim 18, wherein at least the lid includes a front side from which the lid is lifted and a back side positioned opposite the front side, and wherein the toe moves in the one direction toward the back side and then the toe moves in the other direction toward the front side.

20. The dispenser of claim 19, wherein the the dispenser further comprises an assembly for moving the leg, and wherein the assembly includes a push rod having a yoke and a shield.

21. The system of claim 19, wherein the shield is positioned against the lid and includes slots, and wherein one end of the leg is pivotally coupled to the lid, the end of the leg including a rounded bar having a pair of spaced-apart ends, the slots configured to permit the ends to rotate and slidably move therein, wherein the yoke includes slots which are configured to hold drag pins which extend from each of the ends, wherein yoke is positioned over at least a portion of the shield, wherein the push rod is movably coupled to a portion of the lid, and wherein the shield, the push rod and the yoke cooperate with the leg to releasably move the leg into the shield and retain the leg within the shield when at least a portion of the lid is positioned in an open loading position.

22. A dispenser for dispensing sheet material, the dispenser comprising:

a housing including a container and a lid which cooperate to provide an inner surface defining an internal compartment configured to hold sheet material therein, the housing including an exit port for withdrawal of sheet material therefrom, wherein at least the lid includes a front side from which the lid is lifted and a back side positioned opposite the front side; and a sheet mover mounted to the housing and configured to move sheet material positioned in the housing, such that when the front side of the lid is lifted, a portion of the sheet mover contacts at least a portion of a sheet material position in the housing and moves in one direction towards the back side of the lid and across and against the portion of the sheet material such that the portion of the sheet material is at least briefly coupled to the portion of the sheet mover and is moved in the one direction, then the sheet mover reverses direction and moves in an opposite direction toward the front side of the lid and upward towards the lid as the lid is lifted, wherein the portion of the sheet material is moved in at least the one direction, and wherein the portion of the sheet material moved is positioned to be easily withdrawn through the exit port by a user.

23. The dispenser of claim 22 wherein the sheet mover includes a leg having one end which is pivotally coupled to the lid of the housing, the leg having a toe positioned on an opposite end which includes a pick, wherein the toe is configured to move over a surface of the portion of the sheet material and the pick is configured to snag the portion to move at least the portion.

24. The dispenser of claim 23, wherein the toe moves across and against the portion of the sheet material towards the back side of the lid to at least briefly snag the portion of the sheet material, and then the toe reverses direction and moves toward the front side of the lid and upward, toward the lid as the lid is lifted upward.

25. The of claim 24, further comprising an assembly carried by at least a portion of the housing and configured to move the leg.

26. The dispenser of claim 25, wherein the assembly includes a push rod having a yoke and a shield.

27. The dispenser of claim 26, wherein the shield is positioned against the lid and includes slots, and wherein one end of the leg is pivotally coupled to the lid, the leg including a rounded bar having a pair of spaced-apart ends, the slots configured to permit the ends of the rounded bar of the pivotal leg to rotate and slidably move therein, and wherein the push rod is movably coupled to a portion of the lid.

28. The dispenser of claim 27 wherein the yoke includes slots which are configured to hold drag pins which extend from the ends of the rounded bar of the pivotal leg, and wherein the yoke is positioned over at least a portion of the shield.

29. The dispenser of claim 28, wherein the shield, the push rod and the yoke cooperate with the pivotal leg to releasably move the leg into the shield and retain the leg within the shield when at least a portion of the lid is positioned in an open loading position.

30. The dispenser of claim 29, wherein when the leg is moved against the lid, the leg is releasably locked in a position by the assembly.

* * * * *